US008013865B2

(12) United States Patent
Imai et al.

(10) Patent No.: US 8,013,865 B2
(45) Date of Patent: Sep. 6, 2011

(54) PROGRAM, INFORMATION STORAGE MEDIUM, IMAGE GENERATION SYSTEM, AND IMAGE GENERATION METHOD FOR GENERATING AN IMAGE FOR OVERDRIVING THE DISPLAY DEVICE

(75) Inventors: Takehiro Imai, Tokyo (JP); Toshihiro Kushizaki, Tokyo (JP); Naohiro Saito, Yokohama (JP); Shigeki Tomisawa, Yokohama (JP); Yoshihito Iwanaga, Yokohama (JP)

(73) Assignee: Namco Bandai Games Inc., Tokyo (JP)

( * ) Notice: Subject to any disclaimer, the term of this patent is extended or adjusted under 35 U.S.C. 154(b) by 0 days.

(21) Appl. No.: 12/559,023

(22) Filed: Sep. 14, 2009

(65) Prior Publication Data

US 2010/0156918 A1 Jun. 24, 2010

Related U.S. Application Data

(63) Continuation of application No. 11/485,965, filed on Jul. 14, 2006, now Pat. No. 7,609,276.

(30) Foreign Application Priority Data

Jul. 20, 2005 (JP) ..... 2005-210538

(51) Int. Cl.
*G09G 5/02* (2006.01)

(52) U.S. Cl. ..... 345/589; 345/592; 345/629

(58) Field of Classification Search ..... 345/589, 345/592, 629; 382/162–167, 254–311
See application file for complete search history.

(56) References Cited

U.S. PATENT DOCUMENTS

| | | | | |
|---|---|---|---|---|
| 6,271,847 | B1 * | 8/2001 | Shum et al. | 345/418 |
| 6,359,631 | B2 | 3/2002 | DeLeeuw | |
| 6,456,323 | B1 | 9/2002 | Mancuso et al. | |
| 6,533,417 | B1 | 3/2003 | Sain | |
| 6,567,096 | B1 | 5/2003 | Oka et al. | |

(Continued)

FOREIGN PATENT DOCUMENTS

EP 681279 A2 11/1995

(Continued)

OTHER PUBLICATIONS

Satoshi Okubo, "Toshiba Will Speed Up Display of Moving Images By Software Only, As Early As 2003, "Nikkei Electronics, Japan, Nikkei Business Publications, Inc., Feb. 17, 2003, vol. 841, p. 41 (with partial English-language Translation).

*Primary Examiner* — Xiao Wu
*Assistant Examiner* — Charles Tseng
(74) *Attorney, Agent, or Firm* — Oliff & Berridge, PLC

(57) ABSTRACT

An image generation system including: a drawing section which draws an object to generate image data; and an overdrive effect processing section which performs overdrive effect processing for the generated image data and generates image data to be output to a display section. The overdrive effect processing section performs the overdrive effect processing based on differential image data between image data generated in a Kth frame and image data generated in a Jth frame (K>J).

9 Claims, 23 Drawing Sheets

U.S. PATENT DOCUMENTS

| | | | |
|---|---|---|---|
| 6,694,486 | B2 | 2/2004 | Frank et al. |
| 6,803,968 | B1 | 10/2004 | Numata |
| 7,095,906 | B2 | 8/2006 | Gu |
| 7,164,421 | B2 | 1/2007 | Miura et al. |
| 7,248,260 | B2 | 7/2007 | Yamaguchi |
| 7,274,370 | B2 | 9/2007 | Paquette |
| 7,388,581 | B1 | 6/2008 | Diard et al. |
| 2003/0030857 | A1 | 2/2003 | Ito |
| 2003/0184556 | A1 | 10/2003 | Hollis et al. |
| 2004/0145599 | A1 | 7/2004 | Taoka et al. |
| 2006/0244707 | A1 | 11/2006 | Furihata et al. |

FOREIGN PATENT DOCUMENTS

| | | |
|---|---|---|
| JP | A-07-020828 | 1/1995 |
| JP | A-2002-032780 | 1/2002 |
| JP | A-2003-051949 | 2/2003 |
| JP | A-2003-143556 | 5/2003 |
| JP | A-2003-295996 | 10/2003 |
| JP | A-2007-026325 | 2/2007 |
| JP | A-2007-026326 | 2/2007 |
| WO | WO 2005/001807 A3 | 1/2005 |

* cited by examiner

FIRST FRAME

SECOND FRAME

THIRD FRAME

RESIDUAL IMAGE

MULTIPLIES DIFFERENTIAL IMAGE DATA BY OVERDRIVE EFFECT INTENSITY COEFFICIENT

IMAGE DATA AFTER
OVERDRIVE EFFECT PROCESSING

MULTIPLIES IMAGE DATA BY DIFFERENCE
REDUCTION EFFECT INTENSITY COEFFICIENT

DIFFERENTIAL IMAGE DATA

MULTIPLIES DIFFERENTIAL IMAGE DATA BY OVERDRIVE EFFECT INTENSITY COEFFICIENT

ADDS DIFFERENCE REDUCTION IMAGE DATA

IMAGE DATA AFTER OVERDRIVE EFFECT PROCESSING

FIG.12

| DIFFERENTIAL IMAGE DATA VALUE | EFFECT INTENSITY COEFFICIENT |
|---|---|
| 0 | 0.0 |
| 1 | 0.0 |
| 2 | 0.0 |
| 3 | 0.0 |
| 4 | 0.05 |
| 5 | 0.05 |
| 6 | 0.05 |
| 7 | 0.05 |
| 8 | 0.05 |
| 9 | 0.05 |
| 10 | 0.10 |
| 11 | 0.10 |
| ⋮ | ⋮ |

FIG.13A

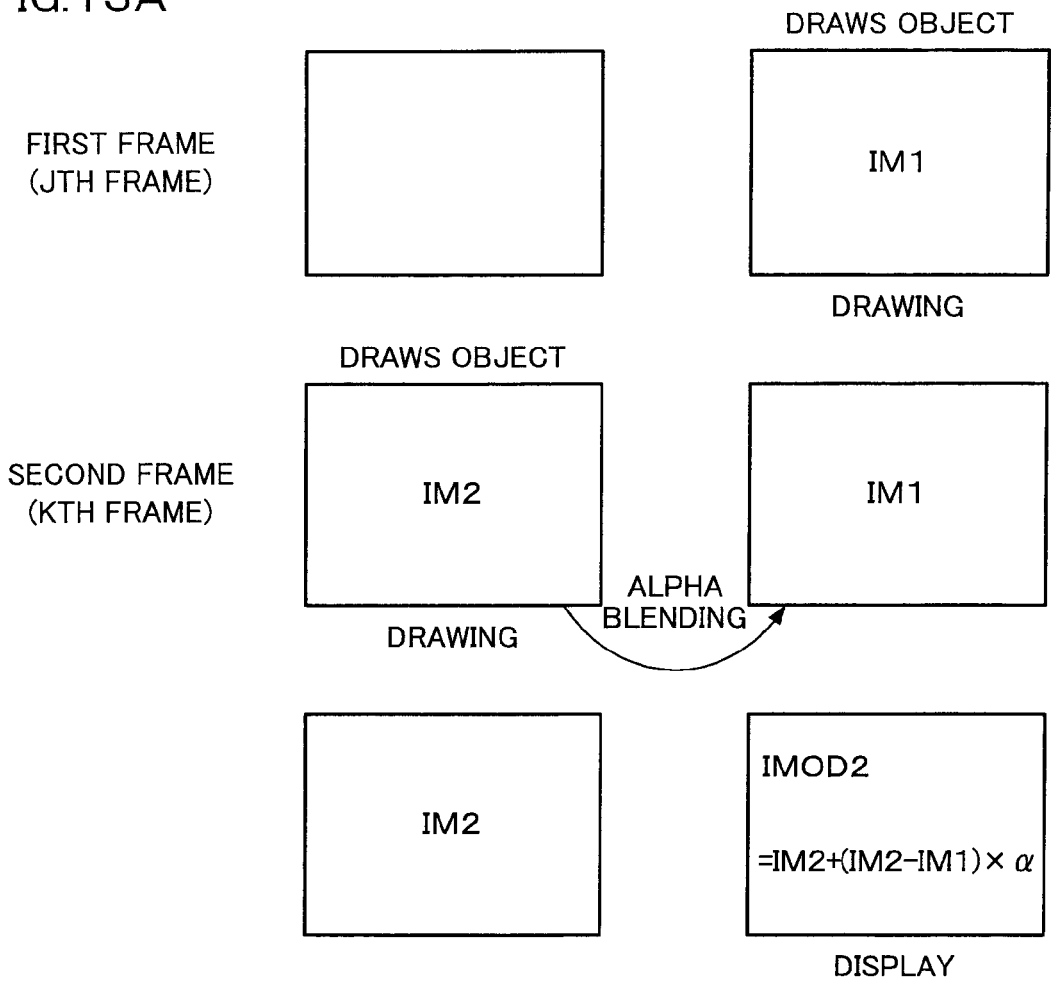

FIG.13B

ALPHA BLENDING EXPRESSION

SUBTRACTIVE ALPHA BLENDING $CS \times A - CD \times B$

ALPHA VALUE INPUT MODE

DOUBLE VALUE MODE $A = 2 \times AS \ (AS = (1 + \alpha)/2)$

FIXED VALUE MODE $B = BS \quad (BS = \alpha)$ $CS = IM2,\ CD = IM1$ $$\Downarrow$$

$$\begin{aligned} CS \times A - CD \times B &= CS \times (2 \times AS) - CD \times BS \\ &= CS \times (1 + \alpha) - CD \times \alpha \\ &= CS + (CS - CD) \times \alpha \\ &= IM2 + (IM2 - IM1) \times \alpha \end{aligned}$$

PROGRAM, INFORMATION STORAGE MEDIUM, IMAGE GENERATION SYSTEM, AND IMAGE GENERATION METHOD FOR GENERATING AN IMAGE FOR OVERDRIVING THE DISPLAY DEVICE

This is a Continuation of application Ser. No. 11/485,965 filed Jul. 14, 2006, which claims the benefit of Japanese Patent Application No. 2005-210538 filed Jul. 20, 2005. The disclosures of the prior applications are hereby incorporated by reference herein in their entirety.

BACKGROUND OF THE INVENTION

The present invention relates to a program, an information storage medium, an image generation system, and an image generation method.

In recent years, a portable game device including a high-quality liquid crystal display device has been popular. In such a portable game device, since the liquid crystal display device can display a realistic high-definition image due to a large number of pixels, a player can enjoy a three-dimensional (3D) game or the like which has not been provided by a portable game device which does not include a high-quality liquid crystal display device.

A liquid crystal display device suffers from a phenomenon in which a residual image occurs when displaying an image moving at a high speed or a moving picture becomes blurred due to the low liquid crystal response speed. As a related-art technology which improves such a phenomenon, a liquid crystal display device including an overdrive circuit has been proposed. The overdrive circuit improves the liquid crystal step input response characteristics by applying a voltage higher than the target voltage in the first frame after the input has changed.

This related-art technology improves the liquid crystal response speed by compensating for the voltage of the image signal. On the other hand, it is difficult to reduce a residual image when a portable game device does not include an overdrive circuit which compensates for the liquid crystal response speed by changing the voltage level.

SUMMARY

According to a first aspect of the invention, there is provided a program for generating an image, the program causing a computer to function as:

a drawing section which draws an object to generate image data; and an overdrive effect processing section which performs overdrive effect processing for the generated image data and generates image data to be output to a display section.

According to a second aspect of the invention, there is provided a computer-readable information storage medium storing the above-described program.

According to a third aspect of the invention, there is provided an image generation system comprising:

a drawing section which draws an object to generate image data; and an overdrive effect processing section which performs overdrive effect processing for the generated image data and generates image data to be output to a display section.

According to a fourth aspect of the invention, there is provided a method for generating an image, comprising:

drawing an object to generate image data; and performing overdrive effect processing for the generated image data and generating image data to be output to a display section.

BRIEF DESCRIPTION OF THE SEVERAL VIEWS OF THE DRAWING

FIG. 12 is a table illustrative of a method of changing an effect intensity coefficient based on a differential image data value.

FIGS. 13A and 13B are views illustrative of a first implementation method for the overdrive effect processing.

DETAILED DESCRIPTION OF THE EMBODIMENT

Figure 1:
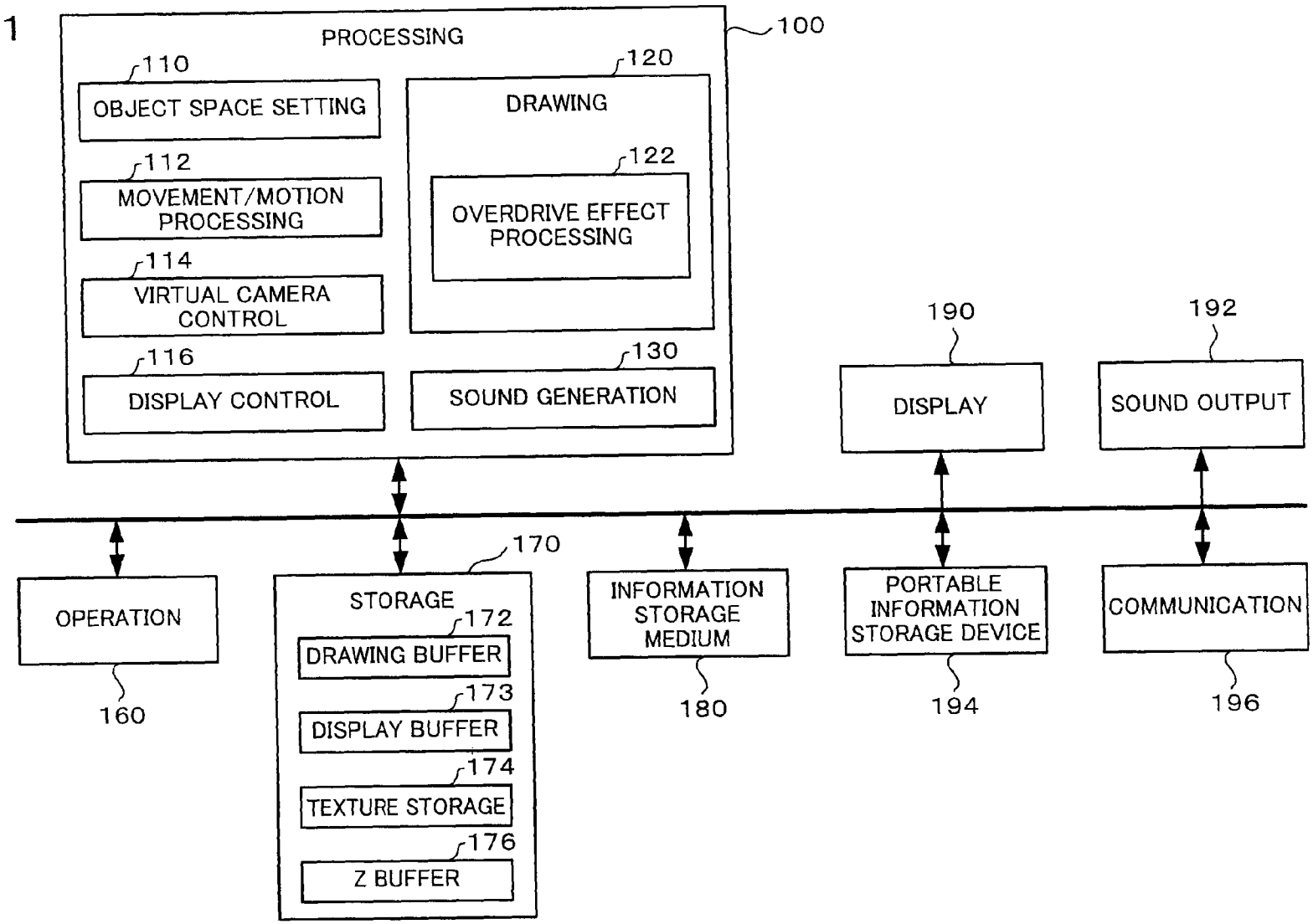
FIG. 1 is an example of a functional block diagram of an image generation system according to one embodiment of the invention.

The invention may provide an image generation system, an image generation method, a program, and an information storage medium which can generate an image with a reduced residual image.

According to one embodiment of the invention, there is provided an image generation system comprising:

a drawing section which draws an object to generate image data; and an overdrive effect processing section which performs overdrive effect processing for the generated image data and generates image data to be output to a display section.

According to one embodiment of the invention, there is provided a program causing a computer to function as the above-described sections. According to one embodiment of the invention, there is provided a computer-readable information storage medium storing a program causing a computer to function as the above-described sections.

In the above embodiments, the image data is generated by drawing the object in a drawing buffer or the like. The generated image data is subjected to the overdrive effect processing, whereby the image data to be output to the display section (display device) is generated. In more detail, the overdrive effect processing is performed as effect processing (post effect processing or filter processing) for image data (original image data) generated by drawing the object, and the image data after the overdrive effect processing is written into a display buffer or the like and output to the display section. Therefore, even if the display section does not include a hardware overdrive circuit, an effect similar to the overdrive effect can be realized by the overdrive effect processing, whereby an image with a reduced residual image can be generated.

In each of the image generation system, program and information storage medium, the overdrive effect processing section may perform the overdrive effect processing based on differential image data between image data generated in a Kth frame and image data generated in a Jth frame (K>J).

This allows the overdrive effect processing corresponding to the differential image data, whereby an image with a further reduced residual image can be generated. The image data generated in the Jth frame may be image data generated by drawing the object, or may be image data obtained by performing the overdrive effect processing for the generated image data.

In each of the image generation system, program and information storage medium, the overdrive effect processing section may add image data obtained by multiplying the differential image data by an effect intensity coefficient to the image data generated in the Kth frame.

This allows the overdrive effect processing corresponding to the effect intensity coefficient, whereby various types of overdrive effect processing can be realized.

In each of the image generation system, program and information storage medium, the overdrive effect processing section may perform the overdrive effect processing based on the effect intensity coefficient which increases as a value of the differential image data increases.

This further reduces a residual image of the generated image.

In each of the image generation system, program and information storage medium, the overdrive effect processing section may store difference reduction image data obtained based on the differential image data in the Kth frame, and perform the overdrive effect processing in an Lth (L>K>J) frame based on differential image data in the Lth frame which is differential image data between image data generated in the Lth frame and image data generated in the Kth frame and the stored difference reduction image data.

This allows the image data output to the display section to be generated based not only on the differential image data in the L frame but also on the differential image data in the Kth frame preceding to the L frame. Therefore, overdrive effect processing which cannot be realized only by the differential image data in the L frame can be realized.

In each of the image generation system, program and information storage medium, the overdrive effect processing section may add image data obtained by multiplying the differential image data in the Lth frame by the effect intensity coefficient and the stored difference reduction image data to the image data generated in the Lth frame.

This allows the difference reduction processing to be realized by simple processing. Note that the difference reduction processing according to these embodiments is not limited to the above processing. For example, the image data obtained by multiplying the differential image data in the Lth frame by the effect intensity coefficient and the stored difference reduction image data may be subtracted from the image data generated in the Lth frame. This reduces the effect of the overdrive effect processing.

In each of the image generation system, program and information storage medium, the overdrive effect processing section may perform the overdrive effect processing for only image data in a specific area of a display area of the display section.

This makes it unnecessary to perform the overdrive effect processing for the entire display area, whereby the processing load can be reduced.

In each of the image generation system, program and information storage medium, the drawing section may generate the image data by drawing a plurality of objects; and the overdrive effect processing section may perform the overdrive effect processing for an area which involves a specific object included in the objects.

This allows the overdrive effect processing to be performed for a specific object to reduce a residual image of the image of that object.

In each of the image generation system, program and information storage medium, the overdrive effect processing section may set the area to perform the overdrive effect processing based on vertex coordinates of the objects, or, when a simple object is set for the objects, vertex coordinates of the simple object.

This simplifies area setting.

The image generation system may comprise a display control section which controls display of an adjustment screen for adjusting effect intensity of the overdrive effect processing, each of the program and information storage medium may cause the computer to function as the display control section, and in each of the image generation system, program and information storage medium, when the effect intensity has been adjusted by using the adjustment screen, the overdrive effect processing section may perform the overdrive effect processing based on the effect intensity after the adjustment.

This realizes the overdrive effect processing corresponding to various display sections.

In each of the image generation system, program and information storage medium, the display control section may move an object set in a second intermediate color in a background area of the adjustment screen set in a first intermediate color.

For example, when the background area or the object is in the primary color, it is difficult to see a residual image which occurs due to the movement of the object, whereby it is difficult to adjust the effect intensity of the overdrive effect processing. On the other hand, a residual image of the object becomes significant on the adjustment screen by using the background area and the object set in different intermediate colors as in the above embodiment, whereby the adjustment accuracy of the adjustment screen can be increased.

The image generation system may comprise a display control section which controls display of a mode setting screen for setting whether or not to enable the overdrive effect processing, each of the program and information storage medium may cause the computer to function as the display control section, and in each of the image generation system, program and information storage medium, the overdrive effect processing section may perform the overdrive effect processing when the overdrive effect processing has been enabled by using the mode setting screen.

This prevents a situation in which the overdrive effect processing is unnecessarily performed when using a display section which does not require the overdrive effect processing, for example.

In each of the image generation system, program and information storage medium, the overdrive effect processing section may generate image data subjected to the overdrive effect processing by performing alpha blending which calculates IMK+(IMK−IMJ)×α a based on image data IMK generated in a Kth frame, image data IMJ generated by drawing an object in a Jth frame (K>J), and an alpha value α.

This makes it possible to generate image data subjected to the overdrive effect processing by merely performing alpha blending for image data generated by drawing an object, whereby an image with a reduced residual image can be generated with a reduced processing load.

In each of the image generation system, program and information storage medium, the overdrive effect processing section may map a texture of the image data IMK onto a primitive plane with a screen size or a divided screen size in which the alpha value is set, and draw the primitive plane onto which the texture has been mapped in a buffer in which the image data IMJ has been drawn while performing alpha blending.

This makes it possible to implement the overdrive effect processing by one texture mapping, for example, whereby the processing load can be reduced. Moreover, the overdrive effect processing can be implemented by effectively utilizing the texture mapping function of the image generation system and the like.

In each of the image generation system, program and information storage medium, the overdrive effect processing section may set AS=(1+α)/2 in a double value mode in which a value twice a set value AS is set as a source alpha value A, set BS=α in a fixed value mode in which a set value BS is set as a fixed destination alpha value B, and perform drawing while performing subtractive alpha blending which calculates IMK×A−IMJ×B=IMK×(2×AS)−IMJ×B=IMK×(1+α)−IMJ×α.

This makes it possible to implement the overdrive effect processing by using a general subtractive alpha blending expression, even if the expression IMK+(IMK−IMJ)×α is not provided as the alpha blending expression.

In each of the image generation system, program and information storage medium, in the Kth frame, the overdrive effect processing section may generate the image data IMK by drawing an object in a first buffer, and write into a second buffer image data subjected to the overdrive effect processing by performing alpha blending which calculates IMK+(IMK−IMJ)×α based on the generated image data IMK, the image data IMJ in the Jth frame which has been written into the second buffer, and the alpha value α;

in an Lth frame, the overdrive effect processing section may generate image data IML by drawing an object in a third buffer, and write into the first buffer image data subjected to the overdrive effect processing by performing alpha blending which calculates IML+(IML−IMK)×α based on the generated image data IML, the image data IMK in the Kth frame which has been written into the first buffer, and the alpha value α; and in an Mth frame (M>L>K), the overdrive effect processing section may generate image data IMM by drawing an object in the second buffer, and write into the third buffer image data subjected to the overdrive effect processing by performing alpha blending which calculates IMM+(IMM−IML)×α based on the generated image data IMM, the image data IML in the Lth frame which has been written into the third buffer, and the alpha value α.

According to this configuration, since the overdrive effect processing is performed while sequentially interchanging the roles of the first buffer, the second buffer, and the third buffer in frame units, it is unnecessary to copy the image data between the buffers. Therefore, the number of processing operations is reduced, whereby the processing load can be reduced.

In each of the image generation system, program and information storage medium, the overdrive effect processing section may generate image data subjected to the overdrive effect processing by performing alpha blending which calculates IMK+(IMK−IMODJ)×α based on image data IMK generated in a Kth frame, image data IMODJ after the overdrive effect processing generated in a Jth frame (K>J), and an alpha value α.

This makes it possible to generate image data subjected to the overdrive effect processing by merely performing alpha blending for image data generated by drawing an object, whereby an image with a reduced residual image can be generated with a reduced processing load.

In each of the image generation system, program and information storage medium, the overdrive effect processing section may map a texture of the image data IMK onto a primitive plane with a screen size or a divided screen size in which the alpha value is set, and draw the primitive plane onto which the texture has been mapped in a buffer in which the image data IMODJ has been drawn while performing alpha blending.

This makes it possible to implement the overdrive effect processing by one texture mapping, for example, whereby the processing load can be reduced. Moreover, the overdrive effect processing can be implemented by effectively utilizing the texture mapping function of the image generation system and the like.

In each of the image generation system, program and information storage medium, the overdrive effect processing section may generate the image data IMK by drawing an object in a drawing buffer, and write into a display buffer image data subjected to the overdrive effect processing by performing alpha blending which calculates IMK+(IMK−IMODJ)×α based on the generated image data IMK, the image data IMODJ after the overdrive effect processing in the Jth frame which has been written into the display buffer, and the alpha value α.

According to this configuration, since the overdrive effect processing can be implemented by a double-buffer configuration including the drawing buffer and the display buffer, the processing load can be reduced by reducing unnecessary processing and the number of processing operations.

According to one embodiment of the invention, there is provide a method for generating an image, comprising:

drawing an object to generate image data; and performing overdrive effect processing for the generated image data and generating image data to be output to a display section.

Embodiments of the invention will be described below. Note that the embodiments described below do not in any way limit the scope of the invention laid out in the claims herein.

In addition, not all of the elements of the embodiments described below should be taken as essential requirements of the invention.

1. Configuration

FIG. 1 is an example of a functional block diagram of an image generation system (game device or portable game device) according to one embodiment of the invention. The image generation system according to this embodiment may have a configuration in which some of the elements (sections) in FIG. 1 are omitted.

An operation section 160 allows a player to input operational data. The function of the operation section 160 may be realized by a lever, button, steering wheel, microphone, touch panel display, casing, or the like. A storage section 170 functions as a work area or a main memory for a processing section 100, a communication section 196, and the like. The function of the storage section 170 may be realized by a RAM (VRAM) or the like.

An information storage medium 180 (computer-readable medium) stores a program, data, and the like. The function of the information storage medium 180 may be realized by an optical disk (CD or DVD), hard disk, memory (ROM), or the like. The processing section 100 performs various types of processing according to this embodiment based on a program (data) stored in the information storage medium 180. Specifically, a program for causing a computer to function as each section according to this embodiment (program for causing a computer to execute the processing procedure of each section) is stored in the information storage medium 180.

A display section 190 outputs an image generated according to this embodiment. The function of the display section 190 may be realized by a CRT, liquid crystal display device (LCD), touch panel type display, head mount display (HMD), or the like. A sound output section 192 outputs sound generated according to this embodiment. The function of the sound output section 192 may be realized by a speaker, headphone, or the like.

A portable information storage device 194 stores player's personal data, game save data, and the like. As the portable information storage device 194, a memory card, a portable game device, and the like can be given. The communication section 196 performs various types of control for communicating with the outside (e.g. host device or another image generation system). The function of the communication section 196 may be realized by hardware such as a processor or a communication ASIC, a program, or the like.

A program (data) for causing a computer to function as each section according to this embodiment may be distributed to the information storage medium 180 (storage section 170) from an information storage medium of a host device (server) through a network and the communication section 196. Use of the information storage medium of the host device (server) may also be included within the scope of the invention.

The processing section 100 (processor) performs game processing, image generation processing, sound generation processing, and the like based on operational data from the operation section 160, a program, and the like. As the game processing, starting a game when game start conditions have been satisfied, proceeding with a game, disposing an object such as a character or a map, displaying an object, calculating game results, finishing a game when game end conditions have been satisfied, and the like can be given. The processing section 100 performs various types of processing by using the storage section 170 as a work area. The function of the processing section 100 may be realized by hardware such as a processor (e.g. CPU or DSP) or ASIC (e.g. gate array) and a program.

The processing section 100 includes an object space setting section 110, a movement/motion processing section 112, a virtual camera control section 114, a display control section 116, a drawing section 120, and a sound generation section 130. Note that the processing section 100 may have a configuration in which some of these sections are omitted.

The object space setting section 110 disposes (sets) in an object space various objects (objects formed by a primitive plane such as a polygon, free-form surface, or subdivision surface) representing display objects such as a character, car, tank, building, tree, pillar, wall, or map (topography). Specifically, the object space setting section 110 determines the position and the rotational angle (synonymous with orientation or direction) of an object (model object) in a world coordinate system, and disposes the object at the determined position (X, Y, Z) and the determined rotational angle (rotational angles around X, Y, and Z axes).

The movement/motion processing section 112 calculates the movement/motion (movement/motion simulation) of an object (e.g. character, car, or airplane). Specifically, the movement/motion processing section 112 causes an object (moving object) to move in the object space or to make a motion (animation) based on the operational data input by the player using the operation section 160, a program (movement/motion algorithm), various types of data (motion data), and the like. In more detail, the movement/motion processing section 112 performs simulation processing of sequentially calculating object's movement information (position, rotational angle, speed, or acceleration) and motion information (position or rotational angle of each part object) in units of frames (1/60 sec). The frame (frame rate) is a time unit for performing the object movement/motion processing (simulation processing) and the image generation processing.

The virtual camera control section 114 (view point control section) controls a virtual camera (view point) for generating an image viewed from a given (arbitrary) view point in the object space. In more detail, the virtual camera control section 114 controls the position (X, Y, Z) or the rotational angle (rotational angles around X, Y, and Z axes) of the virtual camera (i.e. controls the view point position or the line-of-sight direction).

For example, when imaging an object (e.g. character, ball, or car) from behind by using the virtual camera, the virtual camera control section 114 controls the position or the rotational angle (orientation) of the virtual camera so that the virtual camera follows a change in the position or the rotation of the object. In this case, the virtual camera control section 114 may control the virtual camera based on information such as the position, rotational angle, or speed of the object obtained by the movement/motion processing section 112. Or, the virtual camera control section 114 may rotate the virtual camera at a predetermined rotational angle or move the virtual camera along a predetermined path. In this case, the virtual camera control section 114 controls the virtual camera based on virtual camera data for specifying the position (moving path) or the rotational angle of the virtual camera.

The display control section 116 controls display of various screens such as an adjustment screen or a mode setting screen. In more detail, the display control section 116 controls display of the adjustment screen for adjusting the effect intensity (alpha value) of overdrive effect processing. Specifically, the display control section 116 moves an object set in a second intermediate color (color other than the primary colors) differing from a first intermediate color in a background area (area of the adjustment screen or adjustment window) set in the first intermediate color. The display control section 116 also controls display of the mode setting screen for setting whether or not to enable the overdrive effect processing. The overdrive effect processing is performed when the overdrive effect processing has been enabled by using the mode setting screen. A single screen may be used as the adjustment screen and the mode setting screen.

The drawing section 120 draws an image based on the results of various types of processing (game processing) performed by the processing section 100 to generate an image, and outputs the generated image to the display section 190. When generating a three-dimensional game image, geometric processing such as coordinate transformation (world coordinate transformation or camera coordinate transformation), clipping, or perspective transformation is performed, and drawing data (e.g. positional coordinates of vertices of primitive plane, texture coordinates, color data, normal vector, or alpha value) is created based on the processing results. The drawing section 120 draws an image of an object (one or more primitive planes) after perspective transformation (geometric processing) in a drawing buffer 172 based on the drawing data (primitive plane data). This allows an image viewed from the virtual camera (given view point) to be generated in the object space. The generated image is output to the display section 190 through a display buffer 173.

The drawing buffer 172 and the display buffer 173 are buffers (image buffers) which store image information in pixel units, such as a frame buffer or a work buffer, and are allocated on a VRAM of the image generation system, for example. In this embodiment, a double buffer configuration including the drawing buffer 172 (back buffer) and the display buffer 173 (front buffer) may be used. Note that a single buffer configuration or a triple buffer configuration may also be used. Or, four or more buffers may be used. A buffer set as the drawing buffer in the Jth frame may be set as the display buffer in the Kth (K>J) frame, and a buffer set as the display buffer in the Jth frame may be set as the drawing buffer in the Kth frame.

The sound generation section 130 performs sound processing based on the results of various types of processing performed by the processing section 100 to generate game sound such as background music (BGM), effect sound, or voice, and outputs the generated game sound to the sound output section 192.

The drawing section 120 may perform texture mapping, hidden surface removal, and alpha blending.

In texture mapping, a texture (texel value) stored in a texture storage section 174 is mapped onto an object. In more detail, the drawing section 120 reads a texture (surface properties such as color and alpha value) from the texture storage section 174 by using the texture coordinates set (assigned) to the vertices of the object (primitive plane) or the like. The drawing section 120 maps the texture (two-dimensional image or pattern) onto the object. In this case, the drawing section 120 associates the pixel with the texel and performs bilinear interpolation (texel interpolation) or the like.

Hidden surface removal is realized by a Z buffer method (depth comparison method or Z test) using a Z buffer 176 (depth buffer) in which the Z value (depth information) of each pixel is stored, for example. Specifically, the drawing section 120 refers to the Z value stored in the Z buffer 176 when drawing each pixel of the primitive plane of the object. The drawing section 120 compares the Z value in the Z buffer 176 and the Z value of the drawing target pixel of the primitive plane, and, when the Z value of the primitive plane is the Z value in front of the virtual camera (e.g. large Z value), draws that pixel and updates the Z value in the Z buffer 176 with a new Z value.

Alpha blending is performed based on the alpha value (A value), and is divided into normal alpha blending, additive alpha blending, subtractive alpha blending, and the like. The alpha value is information which may be stored while being associated with each pixel (texel or dot), and is additional information other than the color information. The alpha value may be used as translucency (equivalent to transparency or opacity) information, mask information, bump information, or the like.

The drawing section 120 includes an overdrive effect processing section 122. The overdrive effect processing section 122 performs overdrive effect processing using software. In more detail, when the drawing section 120 has drawn an object in the drawing buffer 172 to generate image data (original image data), the overdrive effect processing section 122 performs the overdrive effect processing for the generated image data (digital data) to generate image data output to the display section 190. Specifically, the overdrive effect processing section 122 writes the image data (digital data) subjected to the overdrive effect processing into the display buffer 173 into which the image data output to the display section 190 is written.

In more detail, the overdrive effect processing section 122 performs the overdrive effect processing based on differential image data (differential image plane or differential data value in pixel units) between image data generated in the Kth frame (current frame) and image data generated in the Jth (K>J) frame (preceding frame or previous frame). For example, the overdrive effect processing section 122 performs the overdrive effect processing by adding image data obtained by multiplying the differential image data by an effect intensity coefficient (alpha value) to the image data generated in the Kth frame. In this case, the overdrive effect processing may be performed by using an effect intensity coefficient which increases as the value (absolute value) of the differential image data increases.

Difference reduction image data (image data which is multiplied by an effect intensity coefficient smaller than that of normal overdrive effect processing) obtained based on the differential image data in the Kth frame may be stored in the storage section 170 (main storage section). In this case, the overdrive effect processing section 122 performs the overdrive effect processing based on the differential image data in the Lth frame, which is the differential image data between the image data generated in the Lth frame and the image data generated in the Kth frame, and the stored image data for difference reduction processing. For example, the overdrive effect processing section 122 adds image data obtained by multiplying the differential image data in the Lth frame by the effect intensity coefficient and the difference reduction image data to the image data generated in the Lth frame. This reduces a residual image even when the liquid crystal response speed is extremely low, for example.

The original image data is generated in the drawing buffer 172 by drawing an object (primitive plane) in the drawing buffer 172 while performing hidden surface removal by using the Z-buffer 176 which stores the Z value, for example.

The image generation system according to this embodiment may be a system dedicated to a single player mode in which only one player can play a game, or may be a system provided with a multi-player mode in which two or more players can play a game. When two or more players play a game, game images and game sound provided to the players may be generated by one terminal, or may be generated by distributed processing using two or more terminals (game device or portable telephone) connected through a network (transmission line or communication line), for example.

2. Method of this Embodiment 2.1 Principle of Overdrive Effect Processing

Figure 2A:
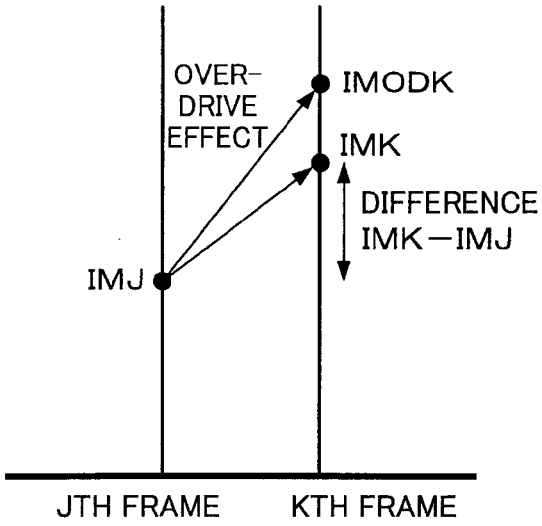
FIGS. 2A to 2C illustrate the principle of overdrive effect processing.
Figure 2B:
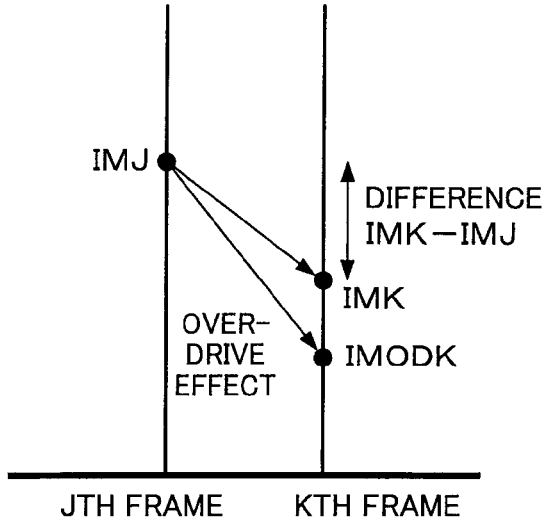

The principle of the overdrive effect processing according to this embodiment is described below. In FIGS. 2A and 2B, consider the case where image data (digital image data value) of one pixel in the Jth frame (preceding frame) is IMJ, and the image data of that pixel in the Kth frame (current frame) is IMK. In this case, if the display section 190 has a sufficiently high response speed, when the correct image data (color data) IMK is written into the display buffer 173 in the Kth frame, the corresponding pixel in the display section 190 has a luminance set by the image data IMK.

On the other hand, when the display section 190 is a liquid crystal display device or the like, since the liquid crystal has a low response speed, even if the correct image data IMK is written into the display buffer 173, the corresponding pixel in the display section 190 may not have a luminance set by the image data IMK. In FIG. 2A, the pixel has a luminance lower than the luminance set by the image data IMK. In FIG. 2B, the pixel has a luminance higher than the luminance set by the image data IMK. As a result, a residual image occurs, or the moving picture becomes blurred.

In this case, such a residual image can be prevented when the display section 190 includes a hardware overdrive circuit. On the other hand, liquid crystal display devices of portable game devices do not generally include such an overdrive circuit. A consumer game device may be connected with various display sections (display devices). For example, a consumer game device may be connected with a tube television or a liquid crystal television. A consumer game device may also be connected with a liquid crystal television provided with an overdrive circuit or a liquid crystal television which is not provided with an overdrive circuit.

When the display section 190 does not include a hardware overdrive circuit, a residual image occurs to a large extent, whereby the quality of the generated game image deteriorates. In particular, when generating a game image in which a plurality of objects (display objects) move at a high speed on the screen, the outline of the object becomes blurred, whereby playing the game may be hindered.

In this embodiment, the above problem is solved by performing the overdrive effect processing using software. Specifically, image data (original image data) generated by drawing an object is directly output to the display section 190 in normal operation. In this embodiment, image data generated by drawing an object is subjected to the overdrive effect processing using software as post-filter processing. In more detail, since the differential image data IMK−IMJ is a positive value in FIG. 2A, the overdrive effect processing in the positive direction is performed by setting image data IMODK after the overdrive effect processing at a value larger than the image data IMK. In FIG. 2B, since the differential image data IMK−IMJ is a negative value, the overdrive effect processing in the negative direction is performed by setting the image data IMODK after the overdrive effect processing at a value smaller than the image data IMK. The image data after the overdrive effect processing is written into the display buffer 173 and output to the display section 190.

This improves the liquid crystal response speed even if the display section 190 does not include a hardware overdrive circuit, whereby a residual image can be reduced.

As processing differing from the overdrive effect processing according to this embodiment, blur processing used to eliminate a flicker is known. In the blur processing, as shown in FIG. 2C, the image data IMJ and the image data IMK in the Jth frame and the Kth frame are blended to generate image data IMBK between the image data IMJ and the image data IMK.

Figure 2C:
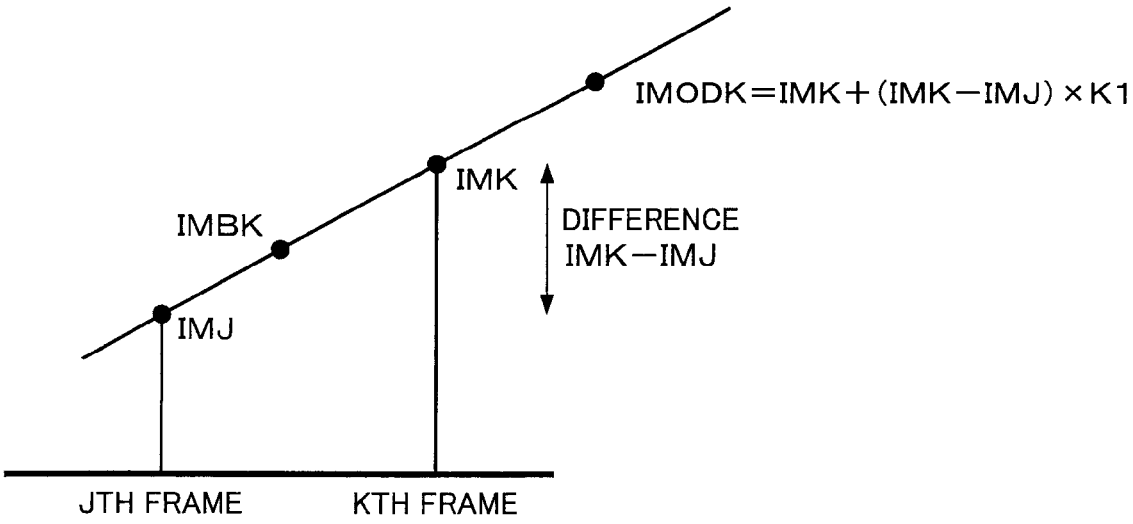

In the overdrive effect processing, the image data IMODK (=IMK+(IMK−IMJ)×K1) exceeding the image data IMK is generated, as shown in FIG. 2C. Specifically, the image data IMODK is generated by calculating the differential image data IMK−IMJ between the image data IMK in the current frame and the image data IMJ in the preceding frame, and adding the image data obtained by multiplying the differential image data IMK−IMJ by an effect intensity coefficient K1 to the image data IMK in the current frame. Therefore, since the image data IMODK exceeding the image data IMK is set as the target value, even if the liquid crystal response speed is low, the corresponding pixel in the display section 190 can be set at a luminance corresponding to the image data IMK.

2.2 Details of Overdrive Effect Processing

Figure 5A:
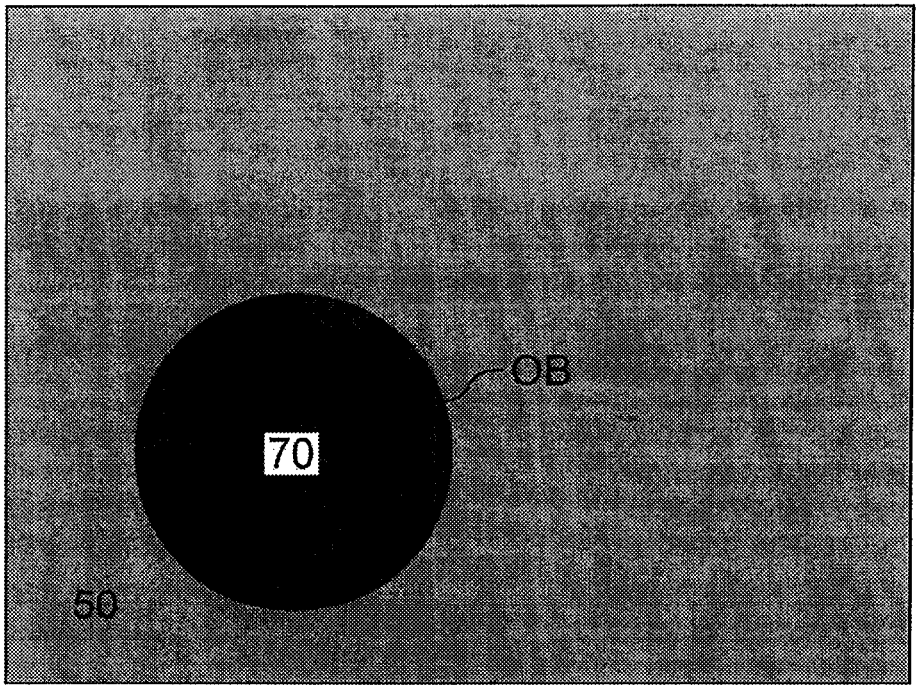
FIGS. 5A and 5B illustrate a residual image of an object.
Figure 5B:
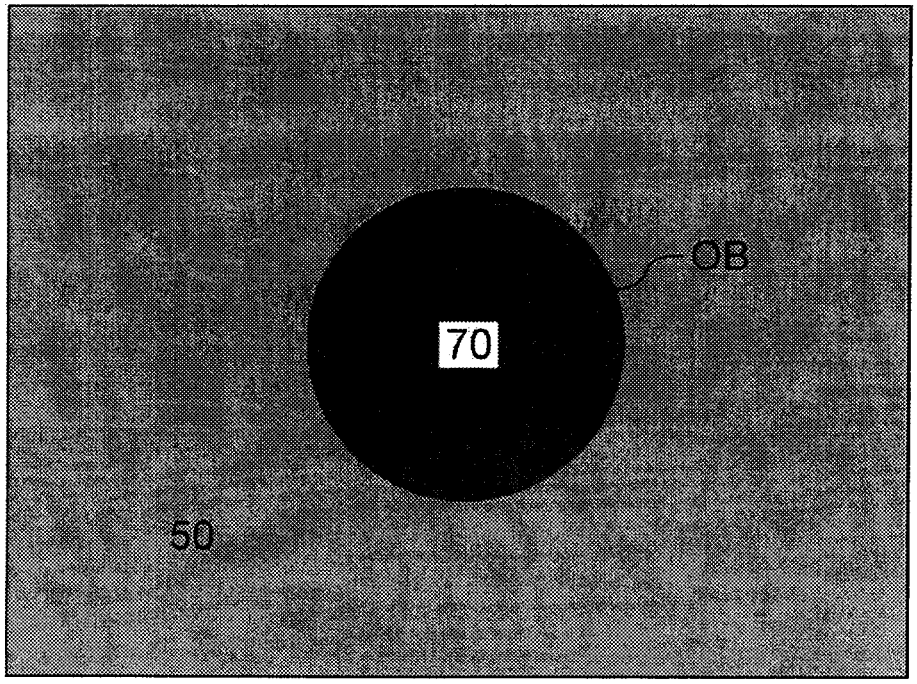
Figure 6A:
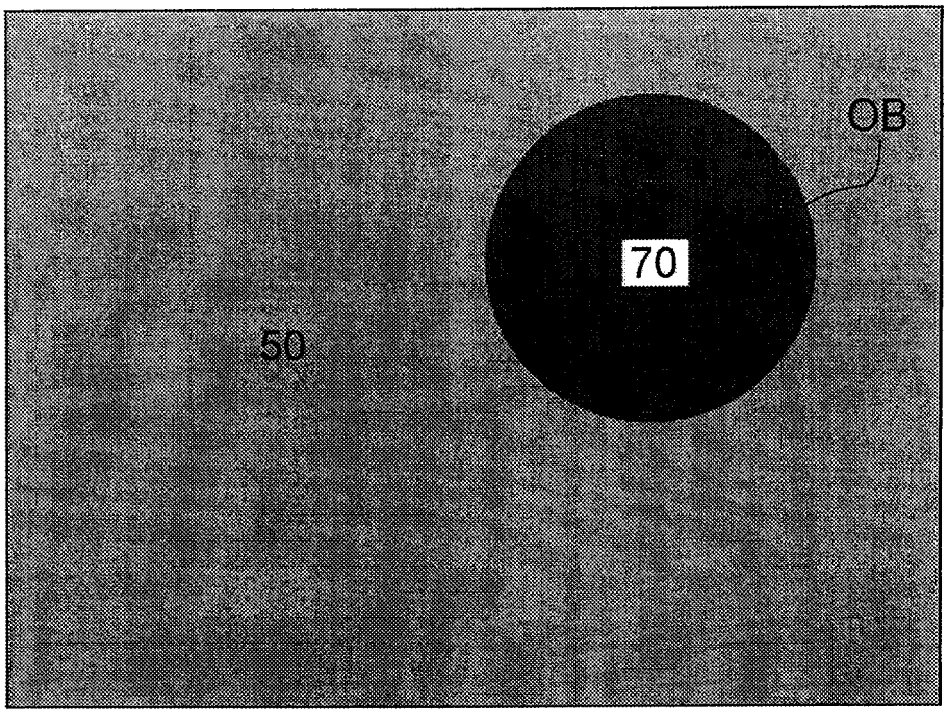
FIGS. 6A and 6B illustrate a residual image of an object.

The details of the overdrive effect processing according to this embodiment are described below with reference to the operation flow sheets of FIGS. 3 and 4. Consider the case where an object OB moves as shown in FIGS. 5A, 5B, and 6A, for example. FIGS. 5A, 5B, and 6A are images in the first frame (Jth frame in a broad sense), the second frame (Kth frame in a broad sense), and the third frame (Lth frame in a broad sense), respectively.

Figure 6B:
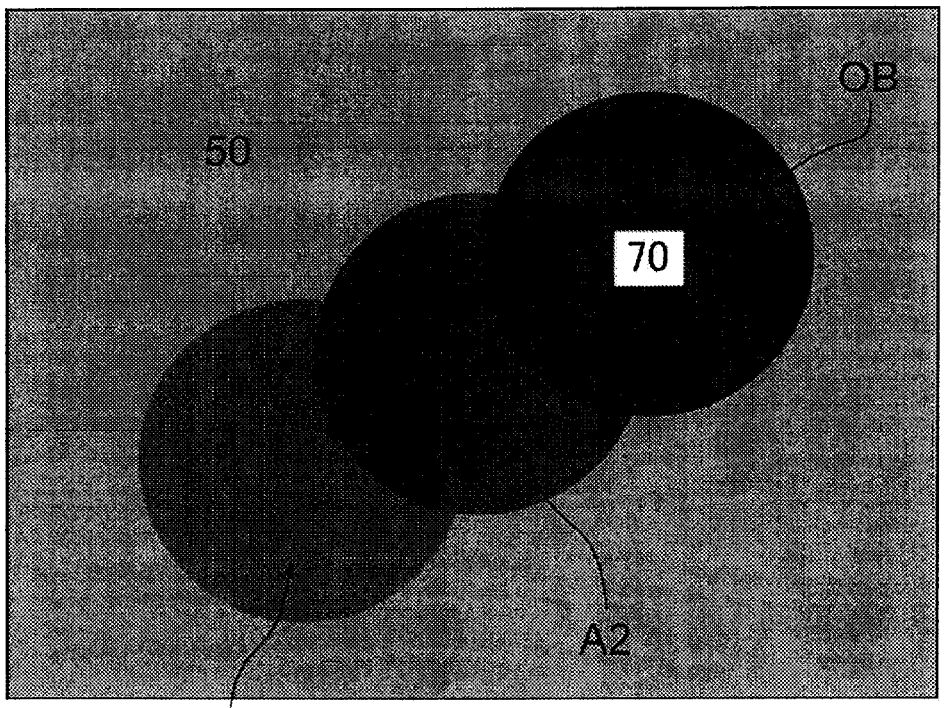

When the maximum value and the minimum value of image data (color data or luminance) are respectively "100" and "0", the value of the image data of the object OB is "70" (intermediate color), and the value of the image data of the background area is "50" (intermediate color). When displaying the object OB moving at a high speed on the display section 190 of the liquid crystal display device, a residual image as shown in FIG. 6 B occurs. Specifically, when the object OB has moved, the area indicated by A1 in FIG. 6B should have a luminance corresponding to the image data "50" of the background area. However, since the liquid crystal has a low response speed, the area indicated by A1 has a luminance higher than the luminance corresponding to the image data "50". As a result, a residual image occurs in the area indicated by A1. The above description also applies to the area indicated by A2.

Figure 3:
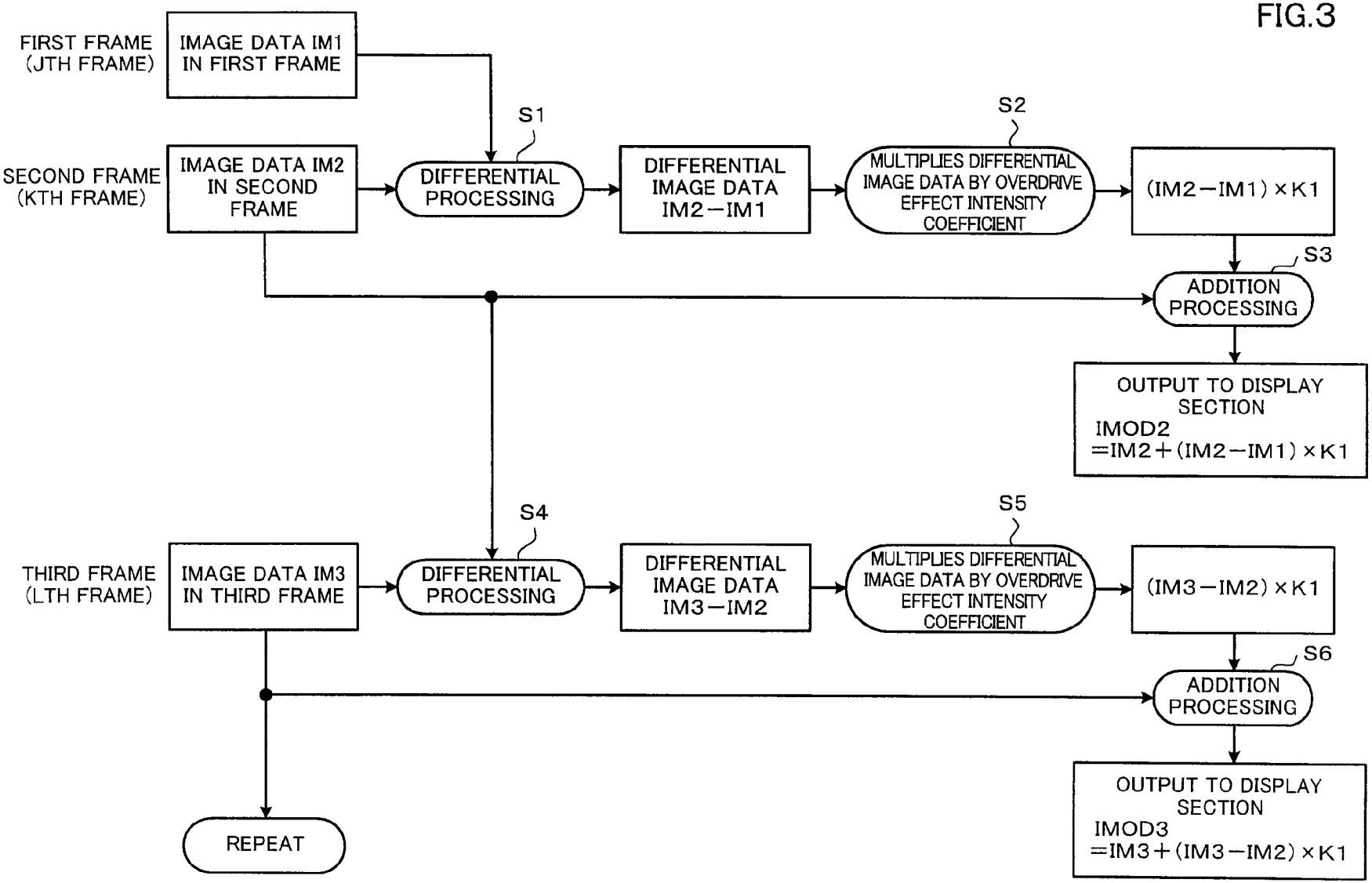
FIG. 3 is an operation flow illustrative of the principle of the overdrive effect processing.

In this embodiment, the overdrive effect processing shown in FIG. 3 is performed in order to prevent such a residual image.

In the second frame, differential processing is performed in which image data IM1 in the first frame (Jth frame) (i.e. preceding (previous) frame) is subtracted from image data IM2 in the second frame (Kth frame) (i.e. current frame) (step S1). This allows differential image data IM2−IM1 (differential mask or differential plane) as shown in FIG. 7A to be generated when the object OB has moved as shown in FIGS. 5A and 5B, for example.

Figure 7A:
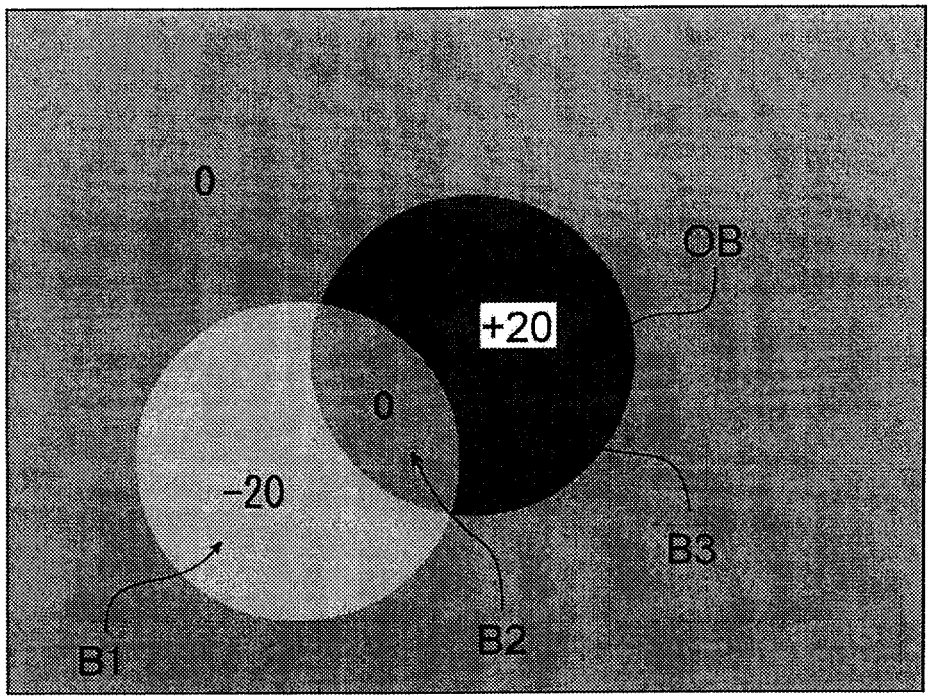
FIGS. 7A and 7B illustrate the overdrive effect processing.

Specifically, since the image data has changed from IM1=70 to IM2=50 in the area indicated by B1 in FIG. 7A, the differential image data IM2−IM1 is 50−70=−20. Since the image data has not changed in the area indicated by B2 (i.e. IM1=70 and IM2=70), the differential image data IM2−IM1 is 0. Since the image data has changed from IM1=50 to IM2=70 in the area indicated by B3, the differential image data IM2−IM1 is 70−50=20.

The differential image data IM2−IM1 is multiplied by the overdrive effect intensity coefficient K1 to generate image data (IM2−IM1)×K1 (step S2).

Figure 7B:
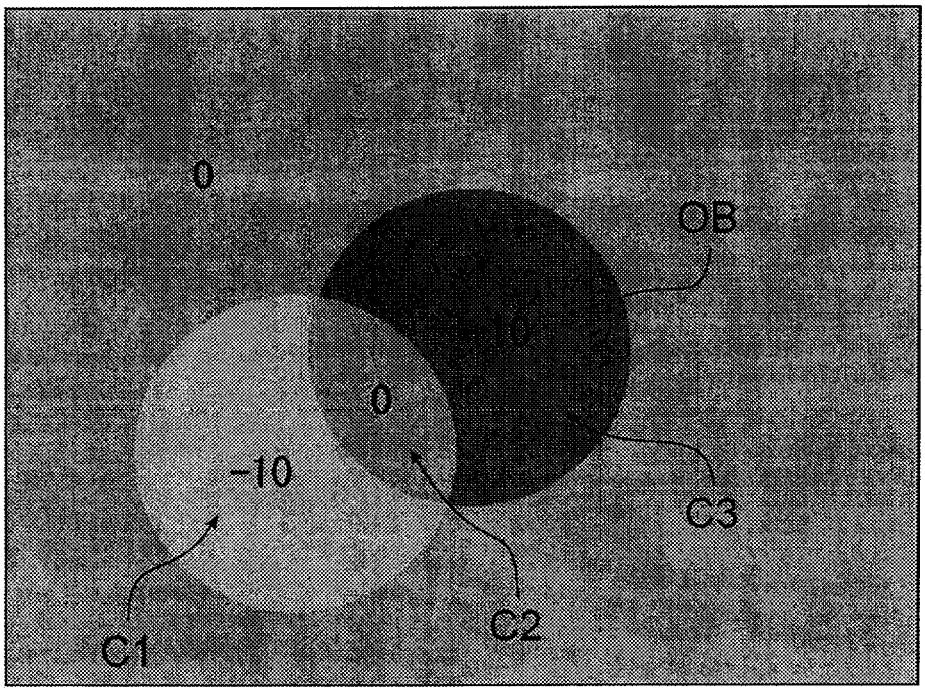

In FIG. 7B, since the effect intensity coefficient K1 is 0.5 and the differential image data in FIG. 7A is multiplied by the effect intensity coefficient K1, the image data in the areas indicated by C1, C2, and C3 is respectively "−10", "0", and "10", for example.

Then, (IM2−IM1)×K1 is added to the image data IM2 in the second frame (current frame) to generate image data IM2+(IM2−IM1)×K1 (step S3). The image data IMOD2=IM2+(IM2−IM1)×K1 generated by the overdrive effect processing is output to the display section 190.

Figure 8A:
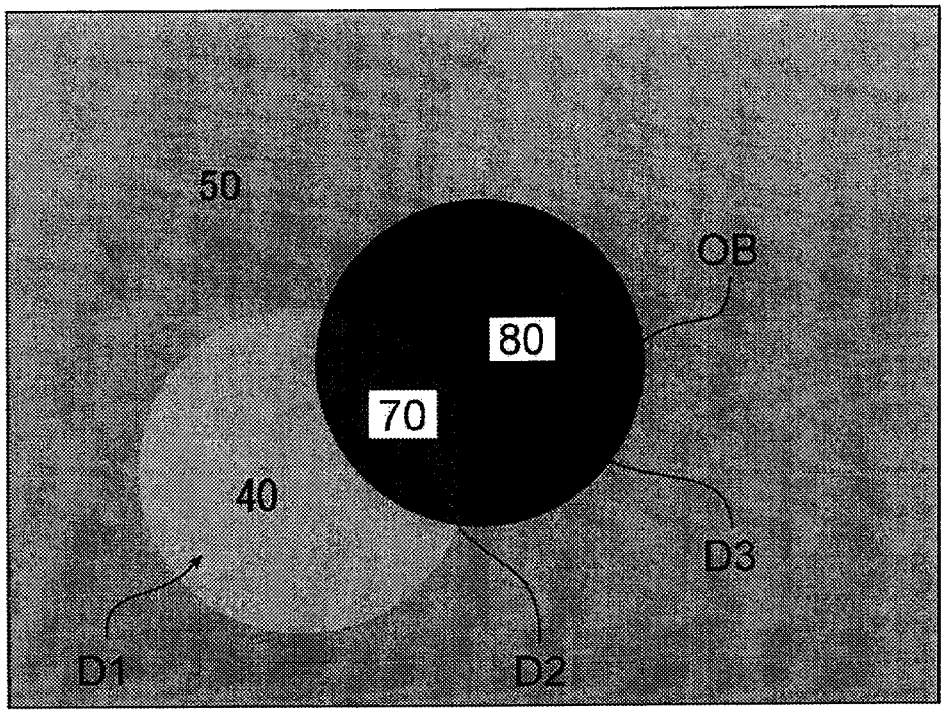
FIGS. 8A and 8B illustrate the overdrive effect processing.

In the area indicated by D1 in FIG. 8A, since the image data (IM2−IM1)×K1=−10 in the area indicated by C1 in FIG. 7B is added to the image data IM2=50 of the background area, the image data after the overdrive effect processing is IMOD2=40, for example. In the area indicated by D2 in FIG. 8A, since the image data (IM2−IM1)×K1=0 in the area indicated by C2 in FIG. 7B is added to the image data IM2=70 of the object OB, the image data after the overdrive effect processing is IMOD2=70. In the area indicated by D3 in FIG. 8A, since the image data (IM2−IM1)×K1=10 in the area indicated by C3 in FIG. 7B is added to the image data IM2=70 of the object OB, the image data after the overdrive effect processing is IMOD2=80. A residual image can be reduced by outputting the image data after the overdrive effect processing, as shown in FIG. 8A, to the display section 190.

In the area indicated by A1 in FIG. 6B, the image data output to the display section 190 is the image data "50" of the background area. A residual image occurs in the area indicated by A1 due to the low liquid crystal response speed. In this embodiment, the image data "40" smaller than the image data "50" of the background area is output to the display section 190 for the area indicated by D1 in FIG. 8B. Specifically, the overdrive effect processing in the negative direction shown in FIG. 2B is performed in the area indicated by D1, whereby the residual image as indicated by A1 in FIG. 6B can be reduced.

In the third frame, the differential processing is performed in which the image data IM2 in the second frame (Kth frame) is subtracted from image data IM3 in the third frame (Lth frame) (step S4). The resulting differential image data IM3−IM2 is multiplied by the overdrive effect intensity coefficient K1 (step S5).

The generated image data (IM3−IM2)×K1 is added to the image data IM3 in the third frame (step S6). The resulting image data IMOD3=IM3+(IM3−IM2)×K1 after the overdrive effect processing is output to the display section 190.

When the liquid crystal response speed is extremely low, a residual image may not be sufficiently reduced by the overdrive effect processing based on the differential image data of one frame.

Figure 4:
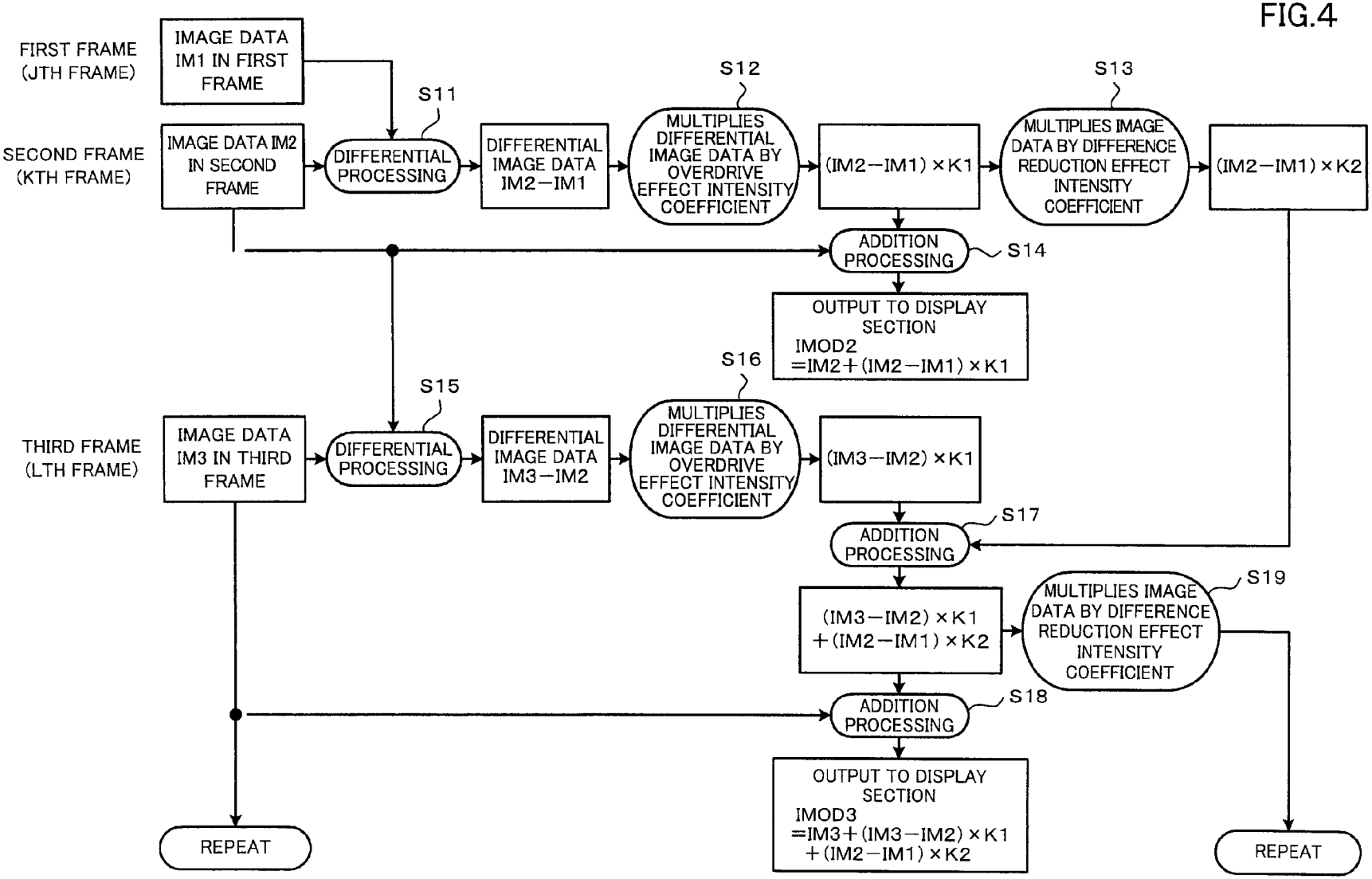
FIG. 4 is an operation flow illustrative of the overdrive effect processing using difference reduction processing.

In the operation flow shown in FIG. 4, difference reduction image data obtained based on the differential image data in the previous frame is stored, and the overdrive effect processing is performed based on the differential image data in the current frame and the stored difference reduction image data.

For example, as shown in FIG. 4, the image data (IM2−IM1)×K1 is generated in the second frame by performing the differential processing (step S11) and the multiplication processing (step S12). The image data (IM2−IM1)×K1 is multiplied by a difference reduction effect intensity coefficient to generate difference reduction image data (IM2−IM1)×K2 (step S13). Note that K1>K2. The resulting difference reduction image data (IM2−IM1)×K2 is stored.

Figure 8B:
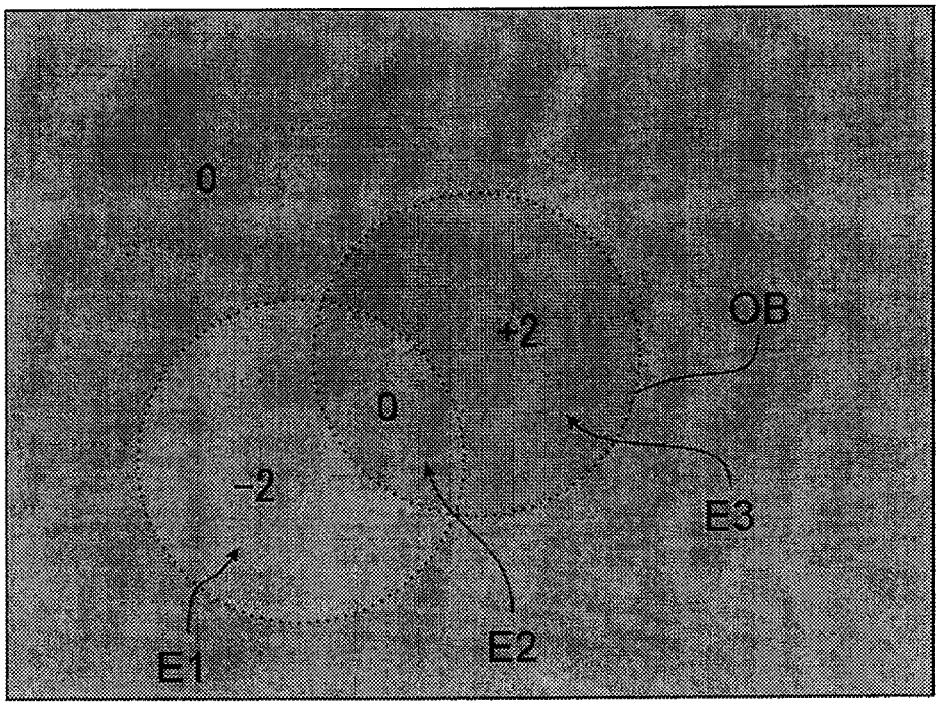

In FIG. 8B, the image data "−10", "0", and "10" indicated by C1, C2, and C3 in FIG. 7B is multiplied by the difference reduction effect intensity coefficient, whereby difference reduction image data "−2", "0", and "2" indicated by E1, E2, and E3 is generated, for example. Note that the difference reduction image data may be generated from the differential image data shown in FIG. 7A.

Figure 9A:
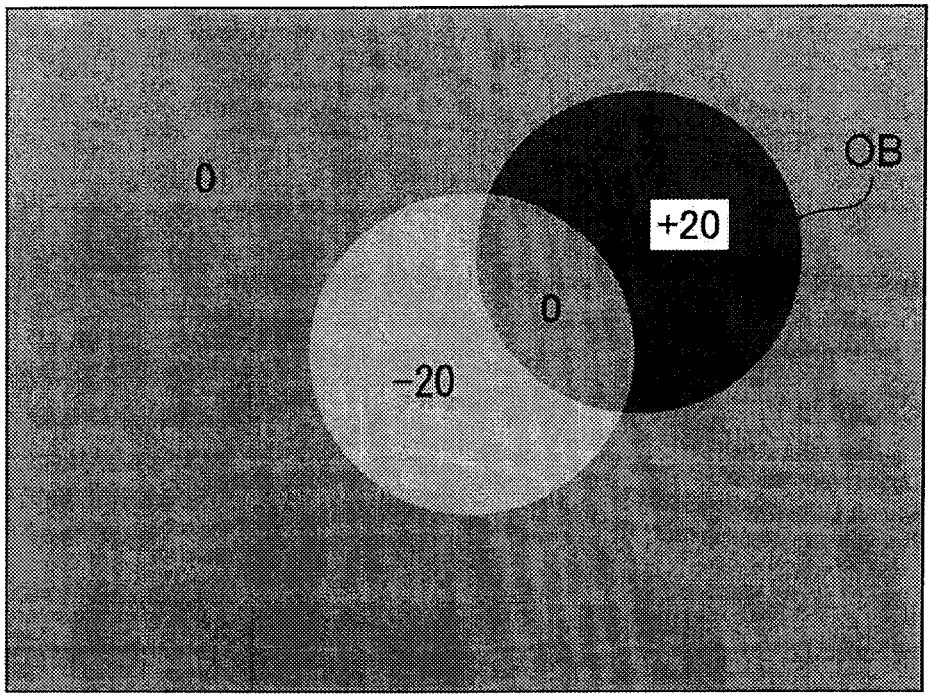
FIGS. 9A and 9B illustrate the overdrive effect processing.
Figure 9B:
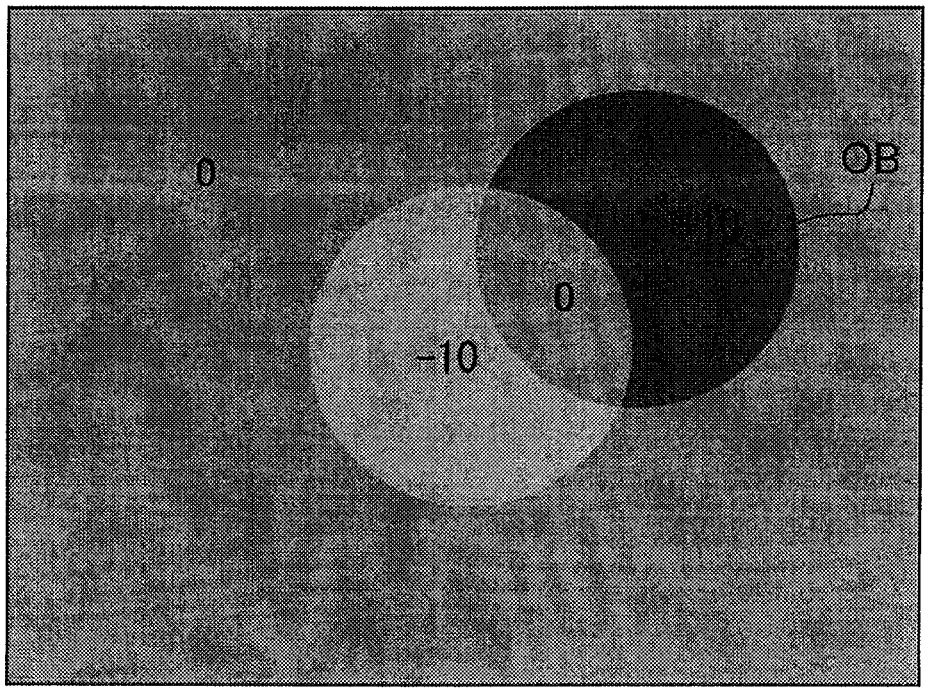

In the third frame, differential image data shown FIG. 9A is generated by performing the differential processing (step S15). The differential image data is multiplied by the overdrive effect intensity coefficient to generate image data (IM3−IM2)×K1 shown in FIG. 9B (step S16).

Figure 10A:
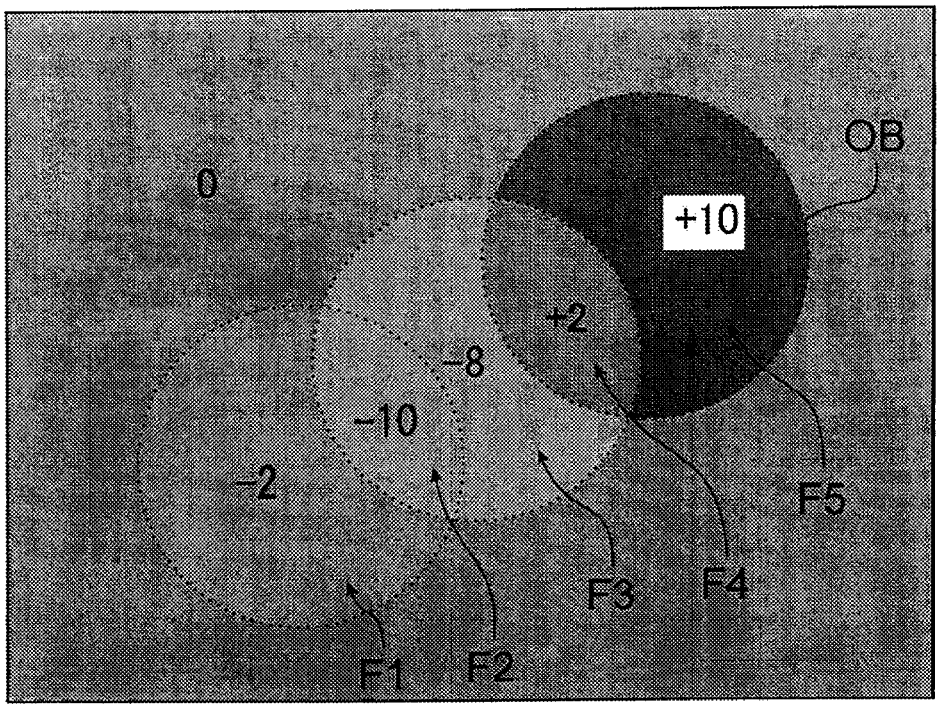
FIGS. 10A and 10B illustrate the overdrive effect processing.

The stored difference reduction image data (IM2−IM1)×K2 is added to (or subtracted from) the generated image data (IM3−IM2)×K1 to generate image data (IM3−IM2)×K1+(IM2−IM1)×K2 (step S17). Specifically, the difference reduction image data shown in FIG. 8B is added to (or subtracted from) the image data shown in FIG. 9B. This allows image data (mask) shown in FIG. 10A to be generated. Specifically, the image data is 0−2=−2 in the area indicated by F1, −10+0=−10 in the area indicated by F2, and −10+2=−8 in the area indicated by F3. The image data is 0+2=2 in the area indicated by F4, and 10+0=10 in the area indicated by F5.

Figure 10B:
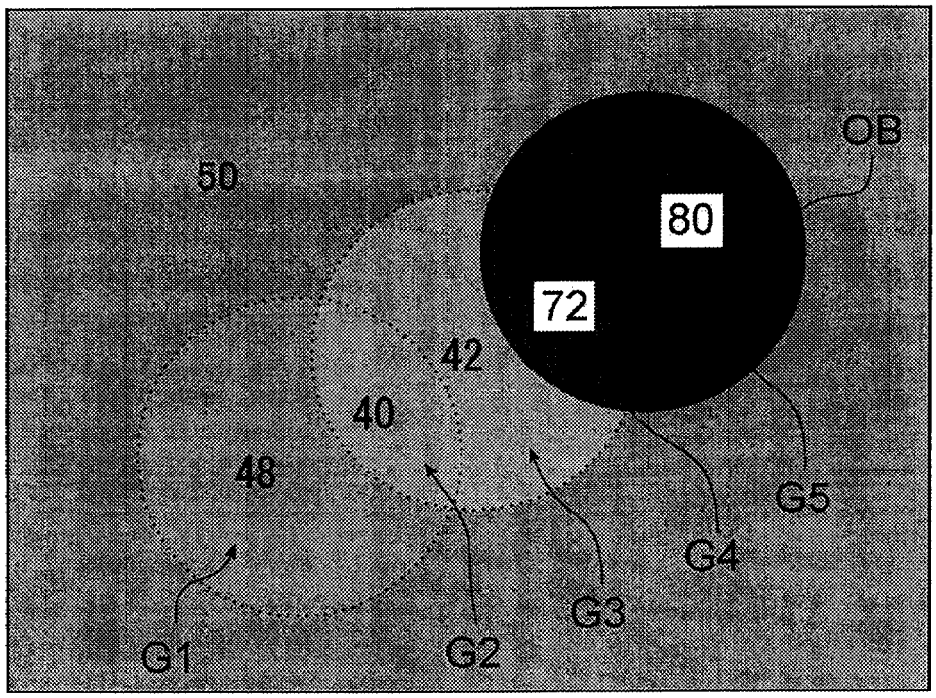

The generated image data (IM3−IM2)×K1+(IM2−IM1)×K2 is added to the image data IM3 in the third frame (step S18). The resulting image data IMOD3=IM3+(IM3−IM2)×K1+(IM2−IM1)×K2 after the overdrive effect processing is output to the display section 190. Specifically, the image data IMOD3 after the overdrive effect processing shown in FIG. 10B is output. The image data (IM3−IM2)×K1+(IM2−IM1)×K2 is multiplied by the difference reduction effect intensity coefficient (step S19).

The overdrive effect processing in which the effect of the previous differential image data is applied in a reduced state can be realized by performing the difference reduction processing shown in FIG. 4. Specifically, when the liquid crystal response speed is extremely low, a residual image may occur in the area indicated by G1 in FIG. 10B if the difference reduction processing is not performed. On the other hand, the overdrive effect processing in the areas indicated by G1 and the like can be realized by performing the difference reduction processing. For example, the overdrive effect processing in the negative direction in an amount of "−2" is performed in the area indicated by G1, whereby a residual image is reduced.

In FIG. 4, the image data (IM2−IM1)×K2 is stored as the difference reduction image data. Note that this embodiment is not limited thereto. Specifically, the difference reduction image data to be stored may be image data obtained based on the differential image data IM2−IM1. For example, the differential image data IM2−IM1 may be stored, or the image data (IM2−IM1)×K1 obtained by multiplying the differential image data by the overdrive effect intensity coefficient may be stored.

Figure 11:
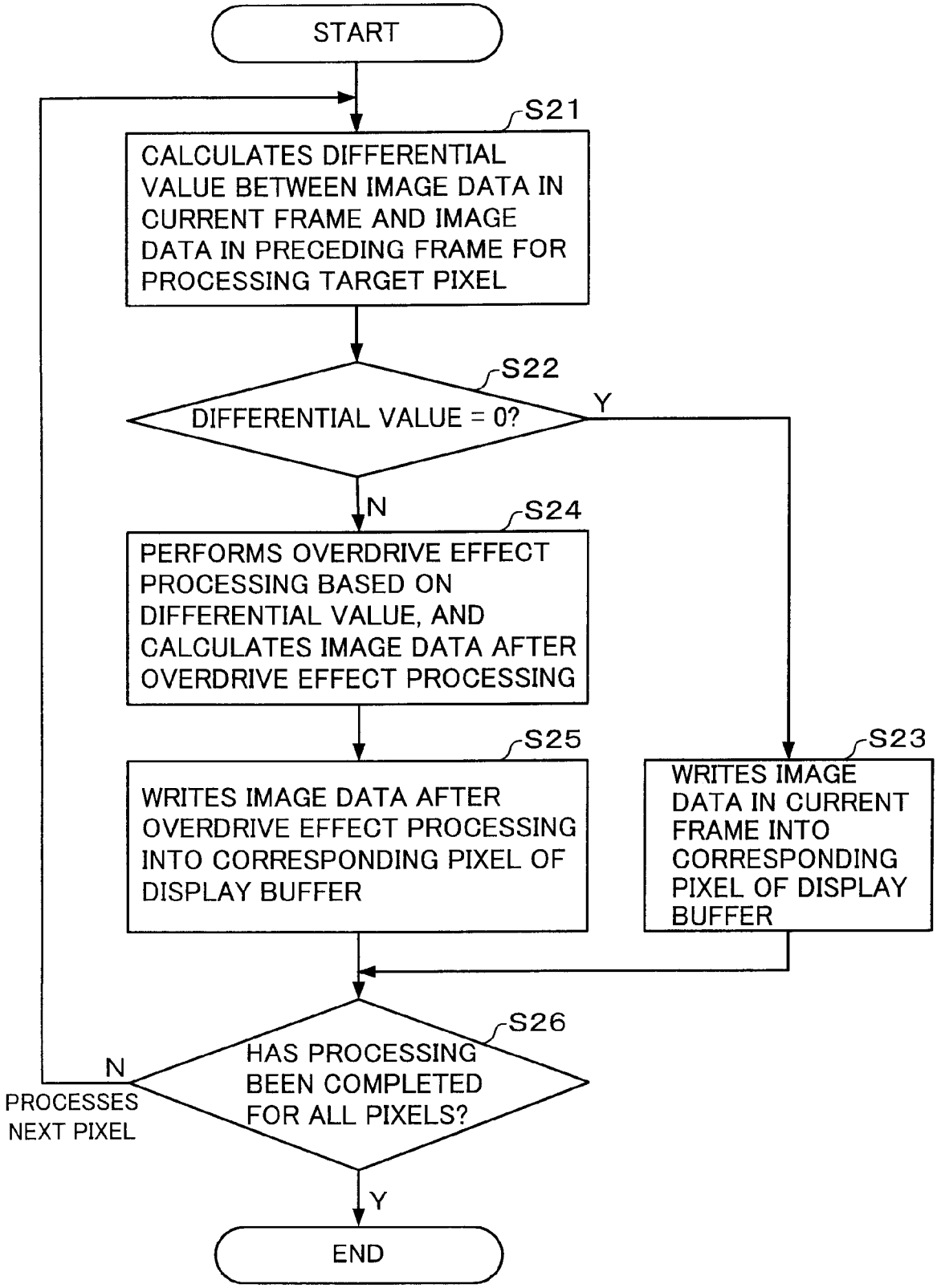
FIG. 11 is a flowchart of the overdrive effect processing performed in pixel units.

The overdrive effect processing according to this embodiment may be performed in image plane units or pixel units. FIG. 11 illustrates an example of the overdrive effect processing performed in pixel units.

The differential value between the image data in the current frame and the image data in the preceding frame is calculated for the processing target pixel (step S21). Whether or not the differential value is 0 is determined (step S22). When the differential value is 0, the image data in the current frame is written into the corresponding pixel of the display buffer (step S23). When the differential value is not 0, the overdrive effect processing is performed based on the differential value, and the image data after the overdrive effect processing is calculated (step S24). The image data after the overdrive effect processing is written into the corresponding pixel of the display buffer (step S25). Whether or not the processing has been completed for all the pixels is determined (step S26). When the processing has not been completed for all the pixels, the processing in the step S21 is performed again for the next pixel. When the processing has been completed for all the pixels, the processing is finished.

FIGS. 3 and 4 illustrate the case where the effect intensity coefficient is a constant (invariable) value. Note that this embodiment is not limited thereto. The effect intensity coefficient may be a variable value. For example, the overdrive effect processing may be performed based on the effect intensity coefficient which increases as the value (absolute value) of the differential image data increases.

In more detail, a table as shown in FIG. 12 is provided in which the differential image data value is associated with the effect intensity coefficient. The effect intensity coefficient is referred to from the table shown in FIG. 12 based on the calculated differential image data value. In the steps S2 and S5 in FIG. 3 or the steps S12 and S16 in FIG. 4, the differential image data is multiplied by the effect intensity coefficient referred to from the table. This allows the effect of the overdrive effect processing to increase as the differential image data value increases, for example. Therefore, a residual image or the like can be minimized even when the liquid crystal response speed is low.

2.3 First Implementation Method for Overdrive Effect Processing

A first implementation method for the overdrive effect processing is described below. In the first implementation method, the overdrive effect processing is realized by performing alpha blending. Specifically, the alpha value is used as the effect intensity coefficient. In more detail, alpha blending indicated by IMK+(IMK−IMJ)×α is performed based on the image data IMK generated in the Kth frame, the image data IMJ generated by drawing the object in the Jth (K>J) frame, and the alpha value α.

In FIG. 13A, the image data IM1 in the first frame (Jth frame) is generated by drawing the object, for example. In the second frame (Kth frame), the image data IM2 is generated by drawing the object. The alpha blending is performed based on the image data IM2 and IM1 and the alpha value α to generate the image data IMOD2=IM2+(IM2−IM1)×α subjected to the overdrive effect processing. The generated image data IMOD2 is output to the display section.

According to the first implementation method, the image data subjected to the overdrive effect processing can be generated by merely performing the alpha blending for the original image data. Therefore, the first implementation method has an advantage in that the processing load is reduced.

Figure 14:
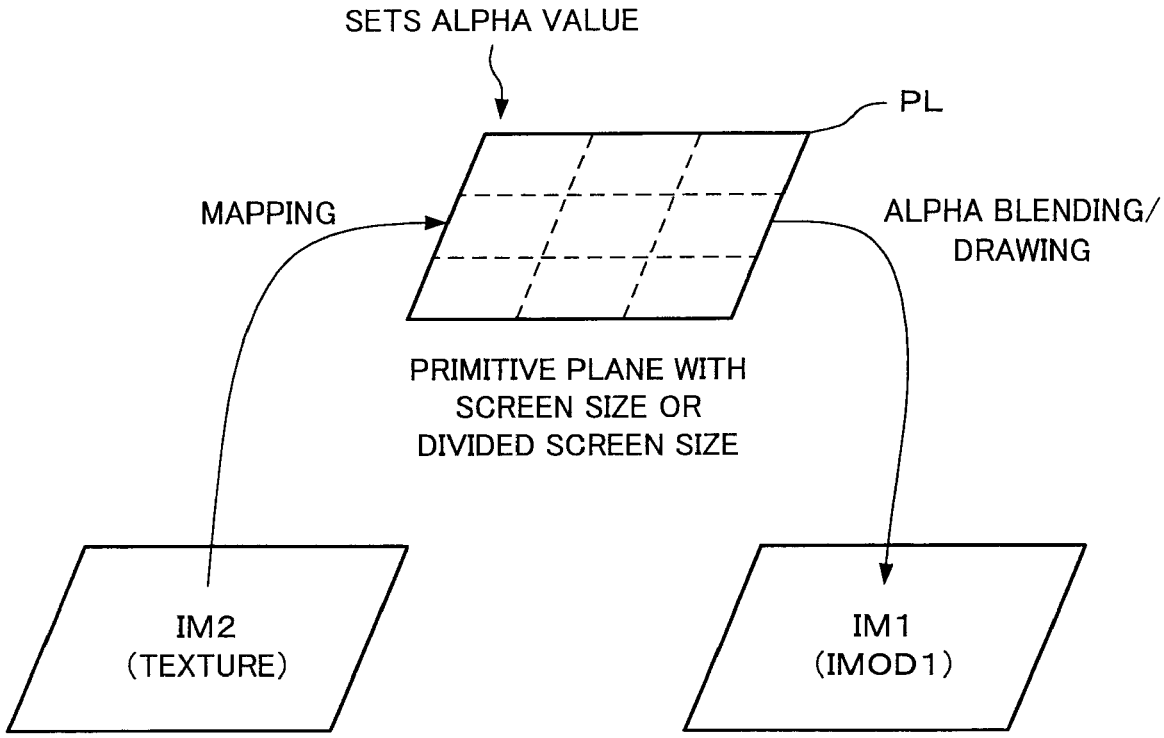
FIG. 14 illustrates a method of mapping a texture onto a primitive plane and drawing an image through alpha blending.

Specifically, as shown in FIG. 14, a texture of the image data IM2 (IMK) is mapped onto a primitive plane PL (sprite or polygon) with a screen size or a divided screen size in which the alpha values are set at the vertices or the like. The primitive plane PL onto which the texture is mapped is alpha-blended and drawn in the buffer (e.g. display buffer) in which the image data IM1 (IMJ) is drawn to generate the image data IMOD2=IM2+(IM2−IM1)×α subjected to the overdrive effect processing. This allows the overdrive effect processing to be realized by mapping the texture once, whereby the processing load can be reduced. This type of image generation system generally has a texture mapping function. Therefore, the first implementation method according to this embodiment has an advantage in that the overdrive effect processing can be realized by effectively utilizing the texture mapping function even if the display section does not include a hardware overdrive circuit.

The alpha blending is provided for translucent processing or blur processing. Specifically, the alpha blending is provided for calculating the image data IMBK between the image data IMK and IMJ in FIG. 2C. Therefore, the expression IM2+(IM2−IM1)×α may not be set in a blending circuit of an image generation system. In such an image generation system, it is difficult to realize the overdrive effect processing indicated by IMOD2=IM2+(IM2−IM1)×α.

Consider the case where only an additive alpha blending expression CS×A+CD×B and a subtractive alpha blending expression CS×A−CD×B can be used in the image generation system, for example.

In this case, in the method shown in FIG. 13B, the subtractive alpha blending expression CS×A−CD×B is set as the alpha blending expression. A set value AS is set in a double value mode in which the value twice the set value AS is set as a source alpha value A. In more detail, the set value AS is set at (1+α)/2. A set value BS is set in a fixed value mode in which the value twice the set value BS is set as a fixed destination alpha value B. In more detail, BS=α is set in a destination alpha value register. The image data IM2 is set as a source color CS, and the image data IM1 is set as a destination color CD.

The alpha blending performed under the above conditions yields the following results.

$$\begin{aligned} CS \times A - CD \times B &= CS \times (2 \times AS) - CD \times BS \\ &= CS \times (1 + \alpha) - CD \times \alpha \\ &= CS + (CS - CD) \times \alpha \\ &= IM2 + (IM2 - IM1) \times \alpha \end{aligned}$$

Therefore, the overdrive effect processing can be realized. Specifically, even if the expression IM2+(IM2−IM1)×α is not provided as the alpha blending expression of the image generation system, the overdrive effect processing can be realized by the general subtractive alpha blending expression CS×A−CD×B.

The first implementation method may be realized by a triple buffer.

Figure 15:
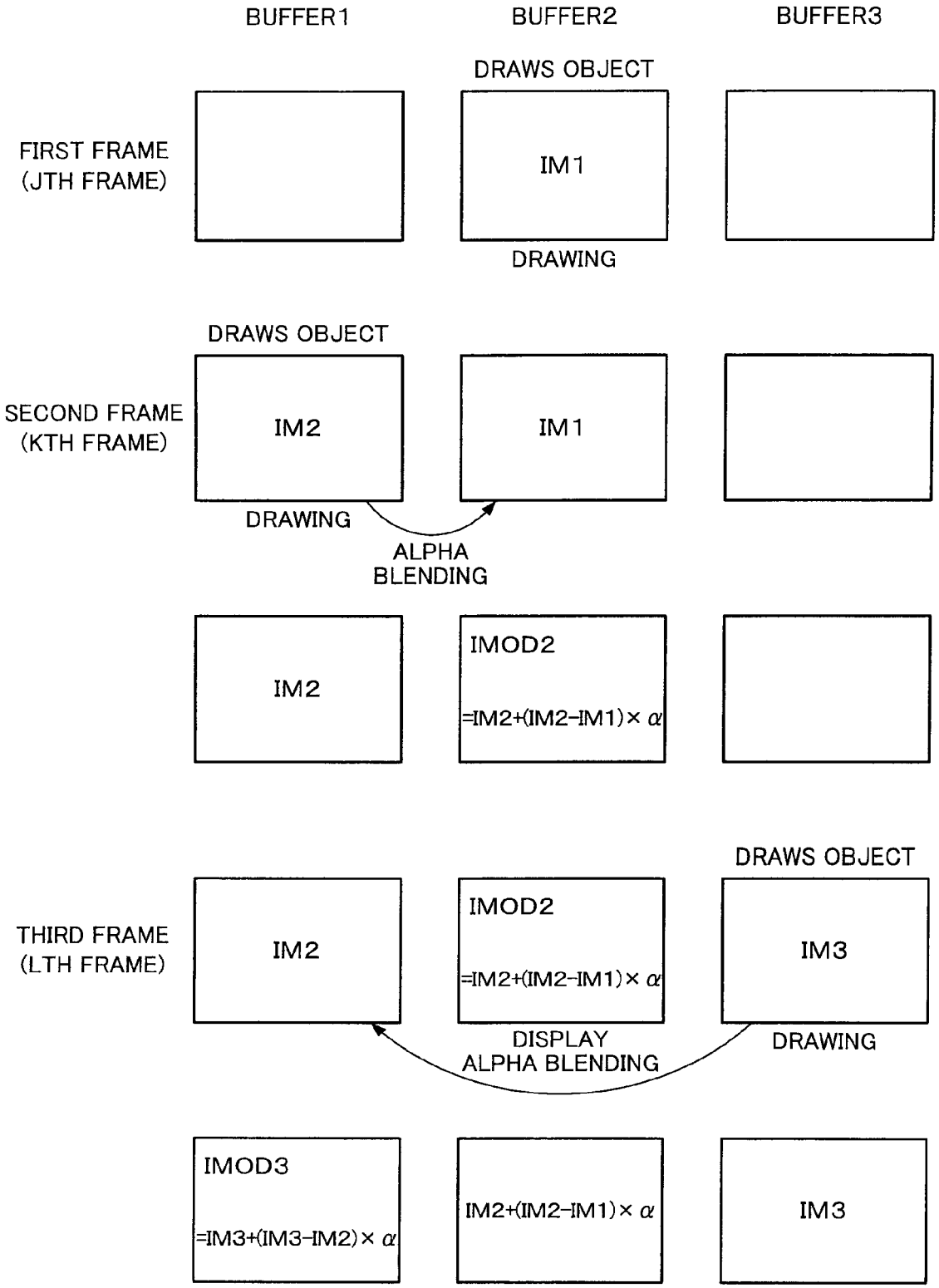
FIG. 15 illustrates the first implementation method using a triple buffer.

In FIG. 15, the object (one or more objects) is drain in a buffer 2 (image buffer) in the first frame (Jth frame) to generate the image data IM1 (IMJ), for example.

In the second frame (Kth frame), the object is drawn in a buffer 1 to generate the image data IM2 (IMK). The alpha blending is performed based on the generated image data IM2, the image data IM1 in the first frame which has been written into the buffer 2, and the alpha value α. The image data IMOD2=IM2+(IM2−IM1)×α after the overdrive effect processing is written into the buffer 2.

In the third frame (Lth frame), the object is drawn in a buffer 3 to generate the image data IM3 (IML). The alpha blending is performed based on the generated image data IM3, the image data IM2 in the second frame which has been written into the buffer 1, and the alpha value α. The image data IMOD3=IM3+(IM3−IM2)×α after the overdrive effect processing is written into the buffer 1.

Figure 16:
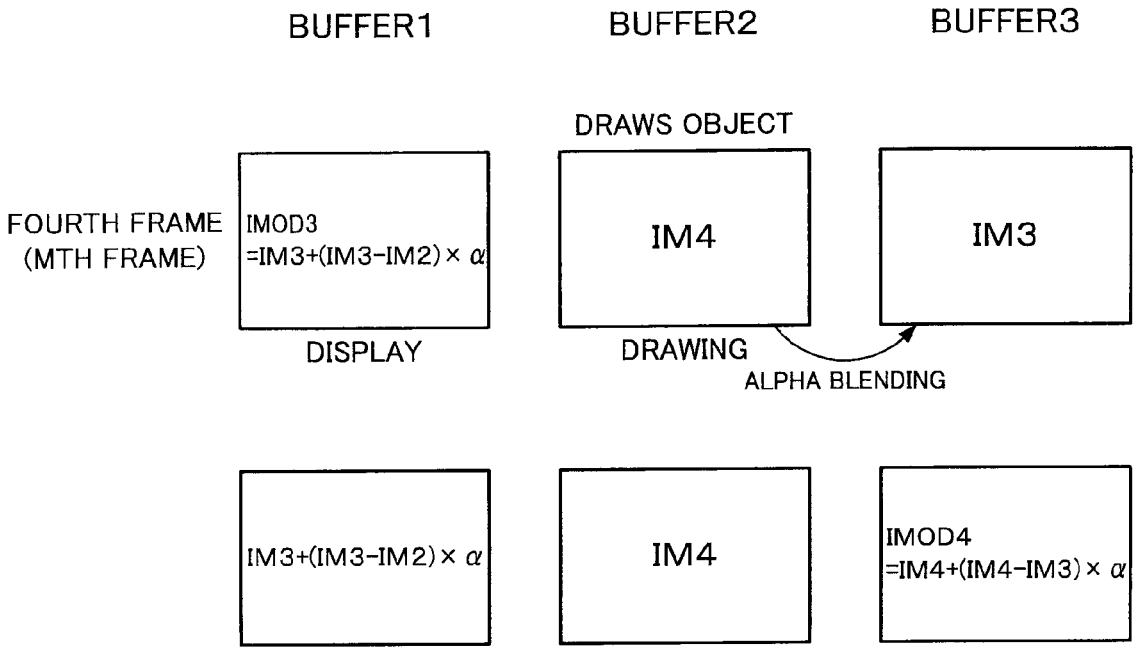
FIG. 16 illustrates the first implementation method using a triple buffer.

In the fourth frame (Mth frame), the object is drawn in the buffer 2 to generate the image data IM4 (IMM), as shown in FIG. 16. The alpha blending is performed based on the generated image data IM4, the image data IM3 in the third frame which has been written into the buffer 3, and the alpha value α. The image data IMOD4=IM4+(IM4−IM3)×α after the overdrive effect processing is written into the buffer 3.

According to the method shown in FIGS. 15 and 16, three buffers 1, 2, and 3 are provided, and the roles (drawing buffer and display buffer) of the buffers 1, 2, and 3 are sequentially changed in frame units. In the third frame, the buffer 3 is set as the drawing buffer (back buffer) in which the object is drawn, and the buffer 2 is set as the display buffer (front buffer) into which the image data output to the display section is written, for example. In the fourth frame, the buffer 2 is set as the drawing buffer, and the buffer 1 is set as the display buffer.

The image data need not be unnecessarily copied between the buffers by sequentially changing the roles of the buffers 1, 2, and 3, whereby the amount of processing is reduced. This reduces the processing load.

A method using a double buffer as in a second implementation method described later may be used as the implementation method for the overdrive effect processing. In this method, the overdrive effect processing is realized by calculating the difference between the image data drawn in the current frame and the image data in the preceding frame after the overdrive effect processing, for example. On the other hand, this method may cause jaggies or the like to occur on the screen when the effect intensity of the overdrive effect processing is increased.

According to the method using the triple buffer, since the image data drawn in the preceding frame can be stored, the difference between the image data drawn in the current frame and the stored image data can be calculated. Therefore, accurate differential image data can be obtained, whereby jaggies or the like can be effectively prevented.

In FIGS. 15 and 16, the overdrive effect processing is realized by using the method of sequentially changing the roles of the buffers 1, 2, and 3. Note that this embodiment is not limited thereto. For example, the overdrive effect processing may be realized by a method in which a differential value buffer is provided in addition to the drawing buffer and the display buffer and the differential image data IMK−IMJ is written into the differential value buffer.

Figure 17:
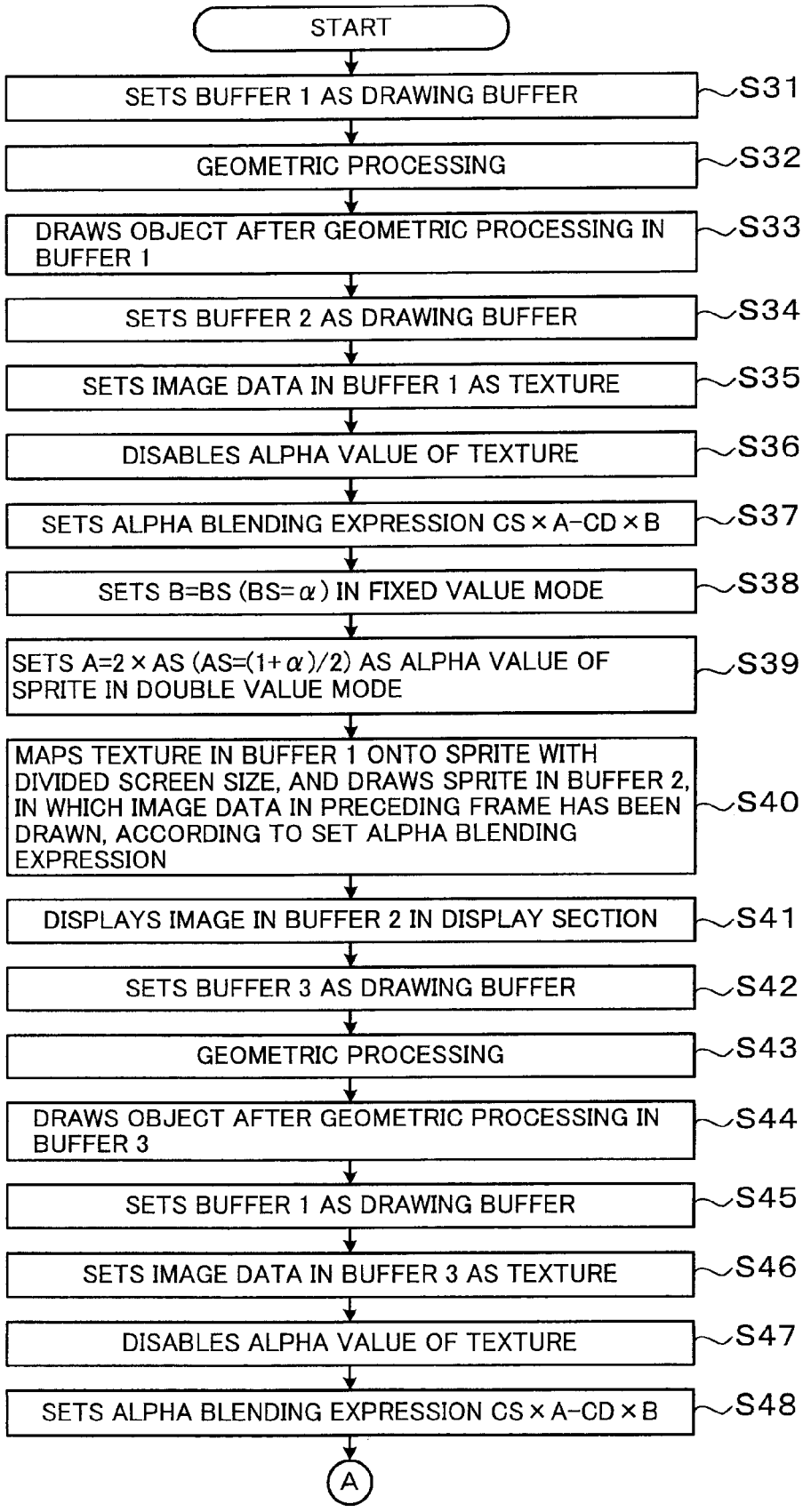
FIG. 17 is a flowchart of the first implementation method for the overdrive effect processing.
Figure 18:
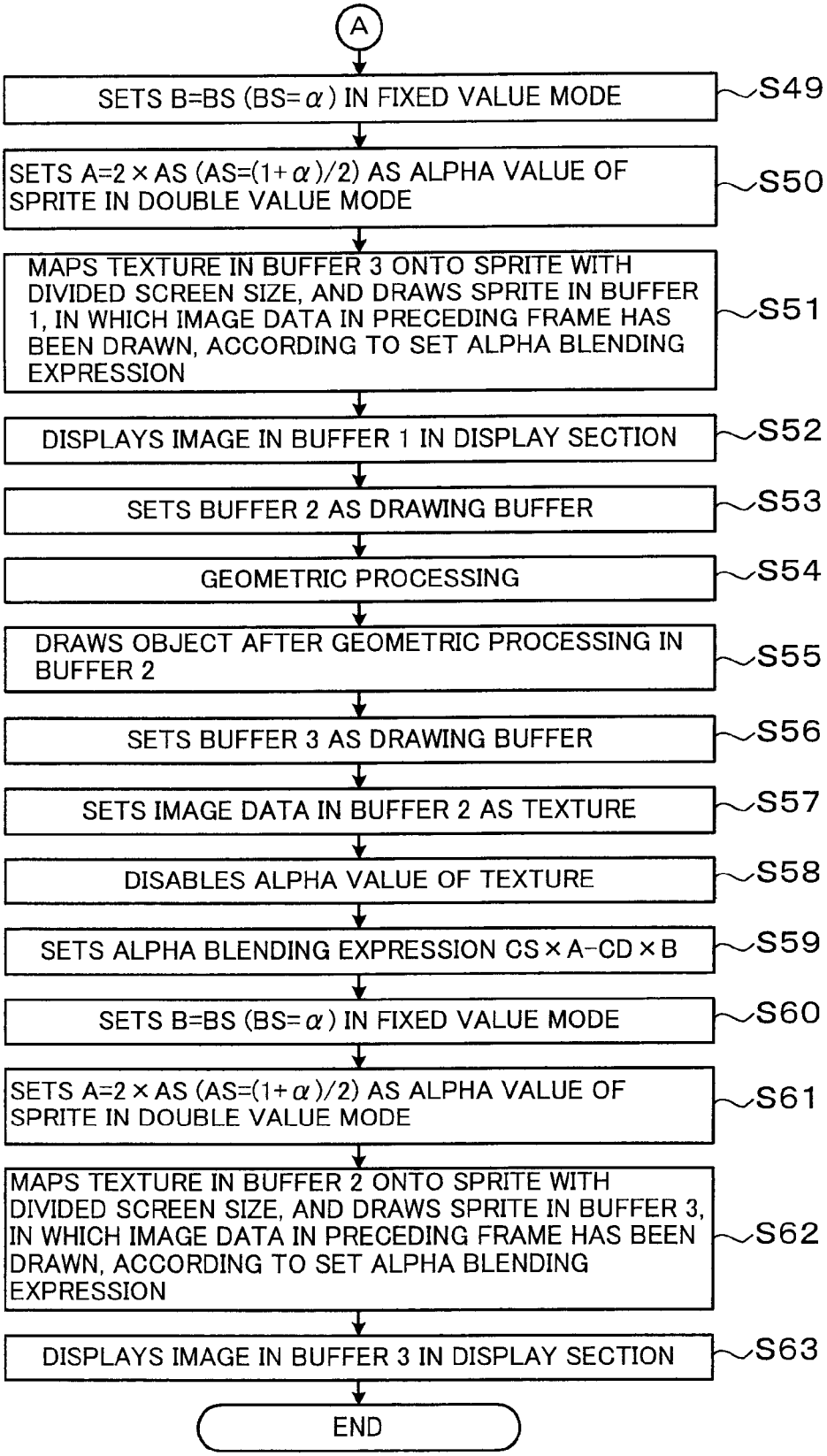
FIG. 18 is another flowchart of the first implementation method for the overdrive effect processing.

The detailed processing of the first implementation method according to this embodiment is described below by using the flowcharts shown in FIGS. 17 and 18.

The buffer 1 is set as the drawing buffer (step S31). The geometric processing is performed (step S32), and the object after the geometric processing is drawn in the buffer 1 (step S33).

The buffer 2 is set as the drawing buffer (step S34). The image data in the buffer 1 is set as the texture (step S35), and the alpha value of the texture is disabled (step S36).

As described with reference to FIG. 13B, the alpha blending expression CS×A−CD×B is set (step S37). Specifically, the subtractive alpha blending expression is set as the alpha blending expression. B=BS=α is set in the fixed value mode (step S38). A=2×AS=1+α is set as the alpha value of the sprite (primitive plane) in the double value mode (step S39).

As described with reference to FIG. 14, the texture in the buffer 1 is mapped onto the sprite with a divided screen size (or screen size), and the sprite is drawn in the buffer 2, in which the image data in the preceding frame has been drawn, according to the set alpha blending expression (step S40). The image in the buffer 2 is displayed in the display section (step S41).

The buffer 3 is set as the drawing buffer, the buffer 1 is set as the display buffer, and the processing similar to the steps S31 to S41 is performed (steps S42 to S52). The buffer 2 is set as the drawing buffer, the buffer 3 is set as the display buffer, and the processing similar to the steps S31 to S41 is performed (steps S53 to S63). This allows the overdrive effect processing using the triple buffer to be realized as described with reference to FIGS. 15 and 16.

2.4 Second Implementation Method for Overdrive Effect Processing

A second implementation method for the overdrive effect processing according to this embodiment is described below. In the second implementation method, the overdrive effect processing is also realized by performing the alpha blending. In more detail, alpha blending indicated by IMK+(IMK−IMODJ)×α is performed based on the image data IMK generated in the Kth frame, the image data IMODJ after the overdrive effect processing generated in the Jth (K>J) frame, and the alpha value α.

Figure 19:
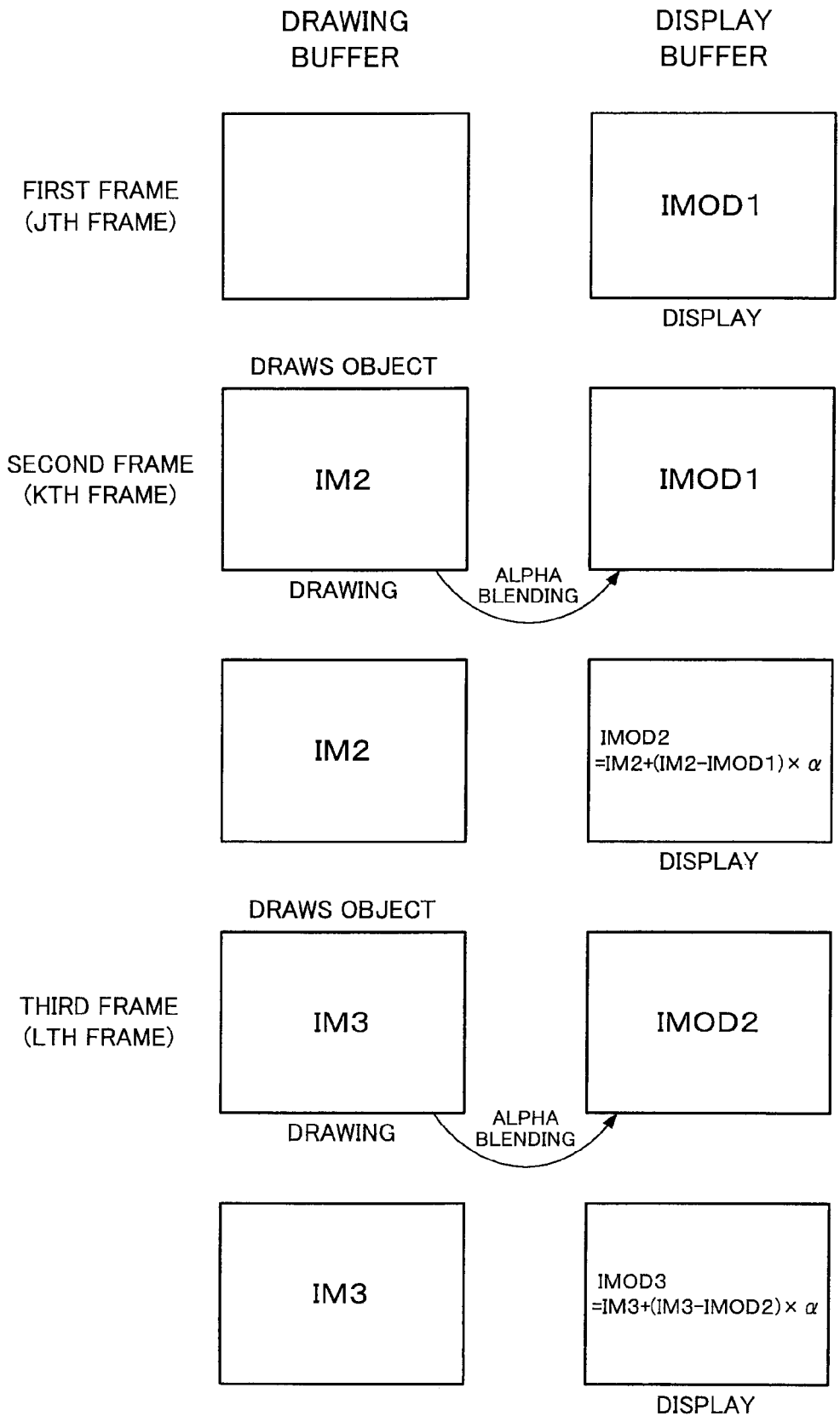
FIG. 19 illustrates a second implementation method for the overdrive effect processing.

In FIG. 19, image data IMOD1 after the overdrive effect processing is written into the display buffer in the first frame (Jth frame), for example. In the second frame (Kth frame), the image data IM2 is generated by drawing the object in the drawing buffer. The alpha blending is performed based on the image data IM2, the image data IMOD1 after the overdrive effect processing generated in the first frame, and the alpha value α to generate the image data IMOD2=IM2+(IM2−−IMOD1)×α after the overdrive effect processing. The generated image data IMOD2 is output to the display section.

In the third frame (Lth frame), the image data IM3 is generated by drawing the object in the drawing buffer. The alpha blending is performed based on the image data IM3, the image data IMOD2 after the overdrive effect processing generated in the second frame, and the alpha value α to generate the image data IMOD3=IM3+(IM3−IMOD2)×α after the overdrive effect processing. The generated image data IMOD3 is output to the display section.

According to the second implementation method, the image data subjected to the overdrive effect processing can be generated by merely performing the alpha blending for the original image data. Therefore, the second implementation method has an advantage in that the processing load is reduced.

Specifically, as shown in FIG. 14, a texture of the image data IM2 (IMK) is mapped onto a primitive plane PL (sprite or polygon) with a screen size or a divided screen size in which the alpha values are set at the vertices or the like. The primitive plane PL onto which the texture is mapped is alpha-blended and drawn in the buffer (e.g. display buffer) in which the image data IMOD1 (IMODJ) is drawn to generate the image data IMOD2=IM2+(IM2−−IMOD1)α subjected to the overdrive effect processing. This allows the overdrive effect processing to be realized by mapping the texture once, whereby the processing load can be reduced. Moreover, the second implementation method according to this embodiment has an advantage in that the overdrive effect processing can be realized by effectively utilizing the texture mapping function of the image generation system, even if the display section does not include a hardware overdrive circuit.

In the first implementation method, the overdrive effect processing is realized by the triple buffer, as shown in FIGS. 15 and 16. On the other hand, the second implementation method realizes the overdrive effect processing by utilizing the double buffer, as shown in FIG. 19. Specifically, the image data is generated in each frame by drawing the object in the drawing buffer, and the alpha blending is performed for the generated image data and the image data after the overdrive effect processing in the preceding frame which has been written into the display buffer. This reduces the memory storage capacity used by the buffer in comparison with the case of using the triple buffer, whereby the memory capacity can be saved.

The second implementation method shown in FIG. 19 also has an advantage in that implementation in the image generation system is easy. For example, the alpha blending is provided for translucent processing or blur processing. Consider the case where only a normal alpha blending expression CS×(1−A)+CD×A can be used in the image generation system. In this case, the second implementation method shown in FIG. 19 sets A=−α. The image data IM2 is set as the source color CS, and the image data IM1 is set as the destination color CD.

The alpha blending performed under the above conditions yields the following results.

$$CS\times(1-A)+CD\times A = CS\times(1+\alpha)-CD\times\alpha$$
$$= CS+(CS-CD)\times\alpha$$
$$= IM2(+IM2-IM1)\times\alpha$$

Therefore, the overdrive effect processing can be realized. Specifically, the overdrive effect processing can be realized by merely using the normal alpha blending expression CS×(1−A)+CD×A as the alpha blending expression of the image generation system and setting A=−α.

Figure 20:
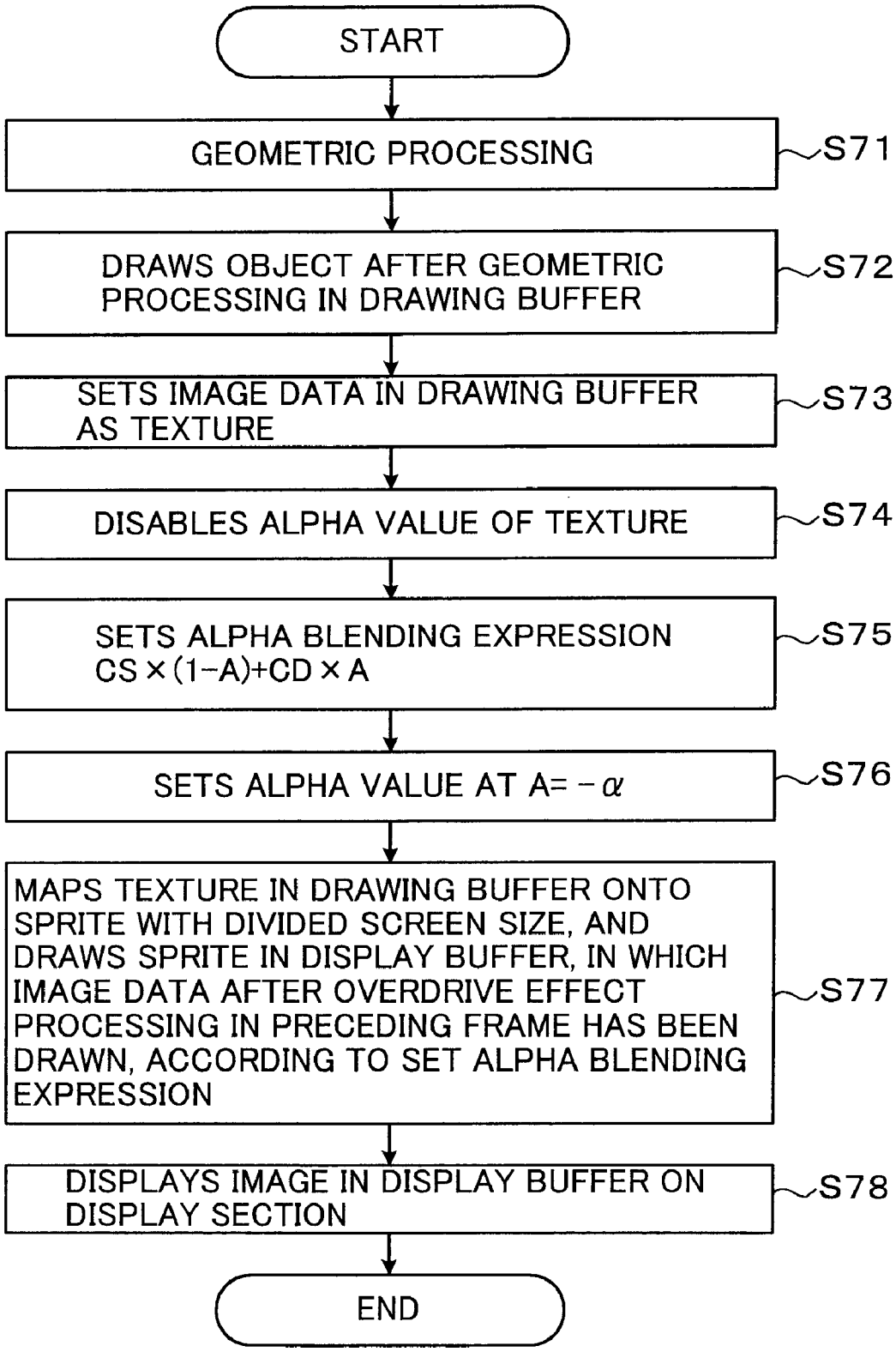
FIG. 20 is another flowchart of the second implementation method for the overdrive effect processing.

The detailed processing of the second implementation method according to this embodiment is described below by using the flowchart shown in FIG. 20.

The geometric processing is performed (step S71), and the object after the geometric processing (perspective transformation) is drawn in the drawing buffer (step S72). The image data in the drawing buffer is set as the texture (step S73), and the alpha value of the texture is disabled (step S74).

The alpha blending expression CS×(1−A)+CD×A is set (step S75). The alpha value is set at A=−α (step S76).

As described with reference to FIG. 14, the texture in the drawing buffer is mapped onto the sprite with a divided screen size (or screen size), and the sprite is drawn in the display buffer, in which the image data in the preceding frame has been drawn, according to the set alpha blending expression (step S77). The image in the display buffer is displayed on the display section (step S78). This allows the overdrive effect processing using the double buffer to be realized as described with reference to FIG. 19.

2.5 Overdrive Effect Processing in Specific Area

When the overdrive effect processing is performed by using a hardware overdrive circuit, the entire area of the display screen undergoes the overdrive effect.

On the other hand, it may suffice to reduce a residual image for only a specific object on the screen depending on the game. For example, it may suffice to reduce a residual image for only an object such as a character which moves on the screen at a high speed or an object with a shape which tends to cause a residual image (e.g. pillar-shaped objects arranged side by side). In this case, the processing load may be reduced by performing the overdrive effect processing for only such an object.

Figure 21A:
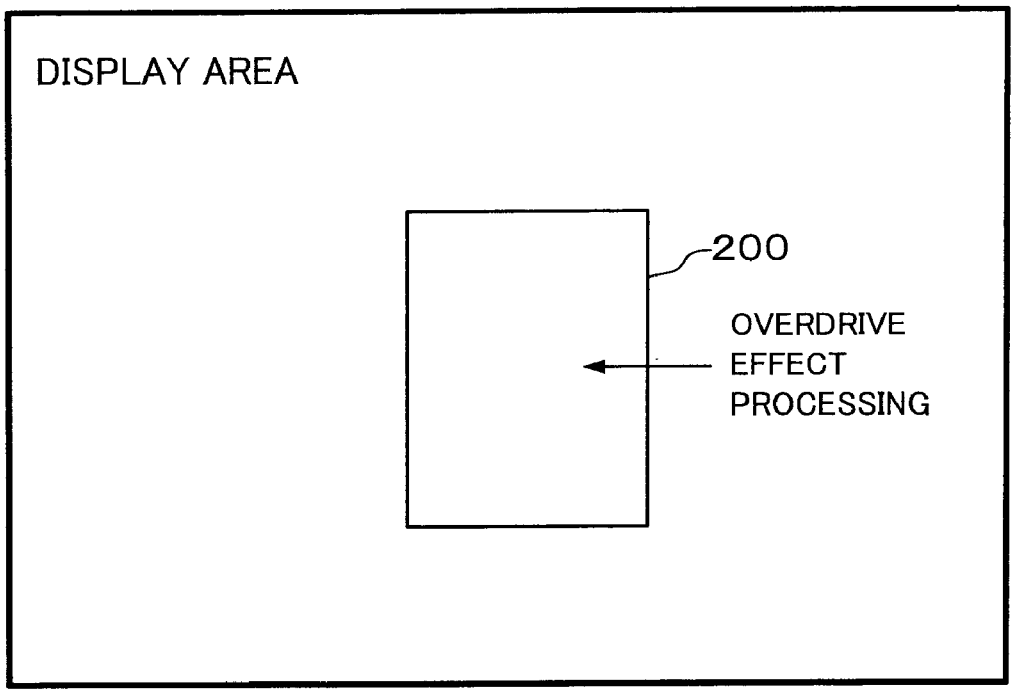
FIGS. 21A and 21B illustrate a method of performing the overdrive effect processing in a specific area included in the display area.

In FIG. 21A, the overdrive effect processing is performed for only image data in a specific area 200 of the display area of the display section. This makes it unnecessary to perform the overdrive effect processing in the area other than the specific area 200. Therefore, the processing load can be reduced when performing the overdrive effect processing by a pixel shader method, for example. Moreover, a situation can be prevented in which the overdrive effect processing is unnecessarily performed for the area in which the overdrive effect processing is not required.

Figure 21B:
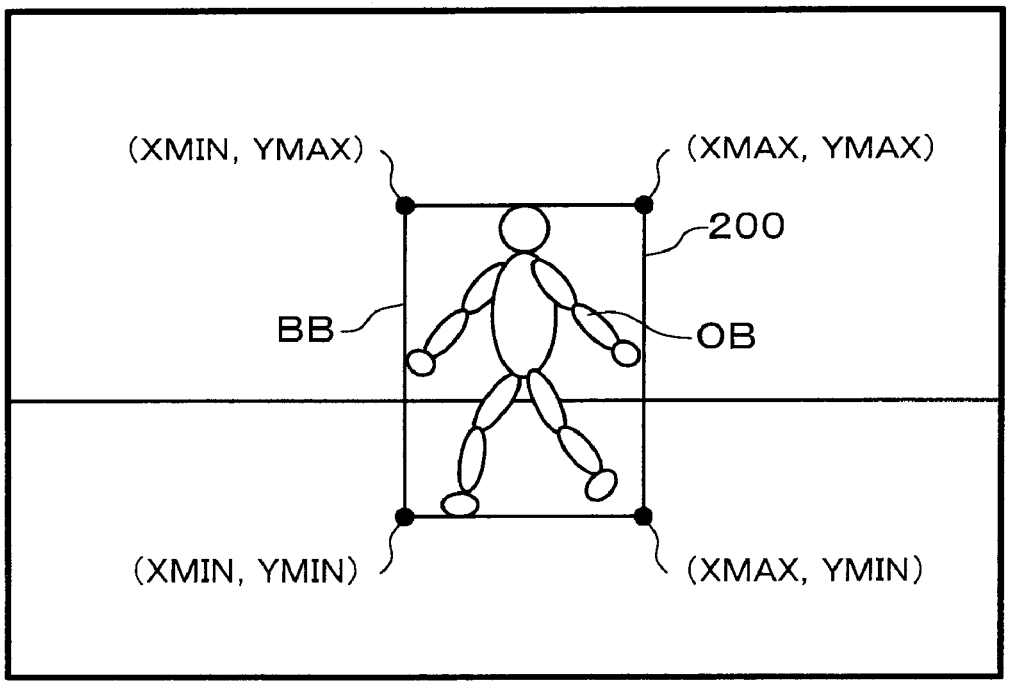

The specific area 200 shown in FIG. 21A may be set based on the object drawn in the drawing buffer. In more detail, when generating image data by drawing a plurality of objects (e.g. objects after perspective transformation), the overdrive effect processing is performed in the area which involves a specific object (model object) included in the objects. In FIG. 21B, the area 200 is set to involve a specific object OB. In more detail, the area 200 is set based on the vertex coordinates (control point coordinates) of the object (object after perspective transformation), and the overdrive effect processing is performed in the area 200.

When a simple object is set for the object, the area 200 in which the overdrive effect processing is performed may be set based on the vertex coordinates of the simple object (simple object after perspective transformation). Specifically, a simple object may be set for the object depending on the game, which is generated by simplifying the shape of the object (i.e. the simple object has the number of vertices less than that of the object and moves to follow the object). For example, whether or not an attack such as a bullet or a punch has hit the object is determined by performing a hit check between the simple object and the bullet or punch. Since the number of vertices of the simple object is small, the processing load can be reduced by setting the area 200 based on the vertex coordinates of the simple object.

Specifically, the area 200 shown in FIG. 21B may be set by the following method. A bounding box BB (bounding volume) which involves the object OB (or simple object) is generated. The bounding box BB may be generated by calculating the X coordinates and the Y coordinates of the vertices of the object OB in the screen coordinate system (vertices of the object OB after perspective transformation), and calculating the minimum value XMIN and the maximum value XMAX of the X coordinates and the minimum value YMIN and the maximum value YMAX of the Y coordinates of the vertices. The bounding box BB may be set to have a size greater to some extent than that shown in FIG. 21B in order to provide a margin.

The primitive plane PL shown in FIG. 14 is set by the generated bounding box BB. The texture of the image data IM2 is mapped onto the primitive plane PL. The primitive plane PL onto which the texture is mapped is alpha-blended and drawn in the buffer in which the image data IM1 (IMODJ) is drawn to generate the image data subjected to the overdrive effect processing.

The method of setting the area 200 is not limited to the method using the bounding box shown in FIG. 21B. For example, the area located at the same position in the display area may be set as the area 200 subjected to the overdrive effect processing.

2.6 Adjustment Screen and Mode Setting Screen

A consumer game device may be connected with various display sections. For example, a consumer game device may be connected with a tube television or a liquid crystal television. A consumer game device may also be connected with a liquid crystal television including an overdrive circuit or a liquid crystal television which does not include an overdrive circuit. A liquid crystal television may have a low or high liquid crystal response speed depending on the product. The same type of portable game devices may be provided with liquid crystal screens of different specifications. A portable game device may also be connected with a tube television or a liquid crystal television as an external monitor.

In this case, if the effect intensity (alpha value) of the overdrive effect processing is fixed, a residual image may occur due to insufficient overdrive effect processing, or a flicker (vibration) may occur due to an excessive degree of overdrive effect processing. Moreover, if the overdrive effect processing cannot be enabled and disabled, a situation may occur in which the overdrive effect processing is unnecessarily performed even if the display section does not require the overdrive effect processing.

Figure 22A:
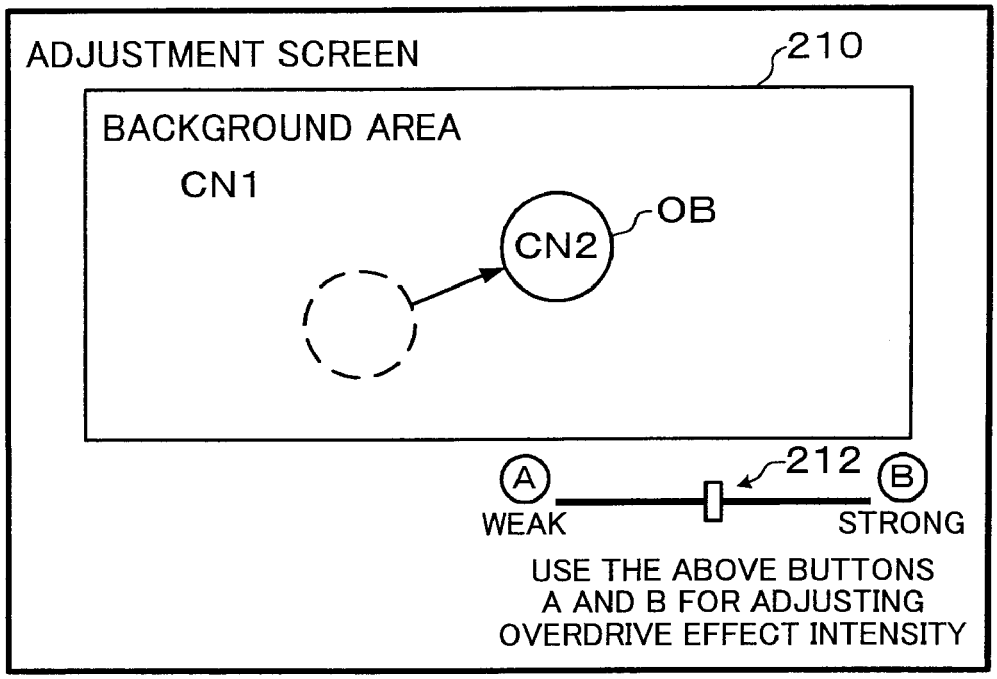
FIGS. 22A and 22B are examples of an adjustment screen and a mode setting screen of the overdrive effect processing.
Figure 22B:
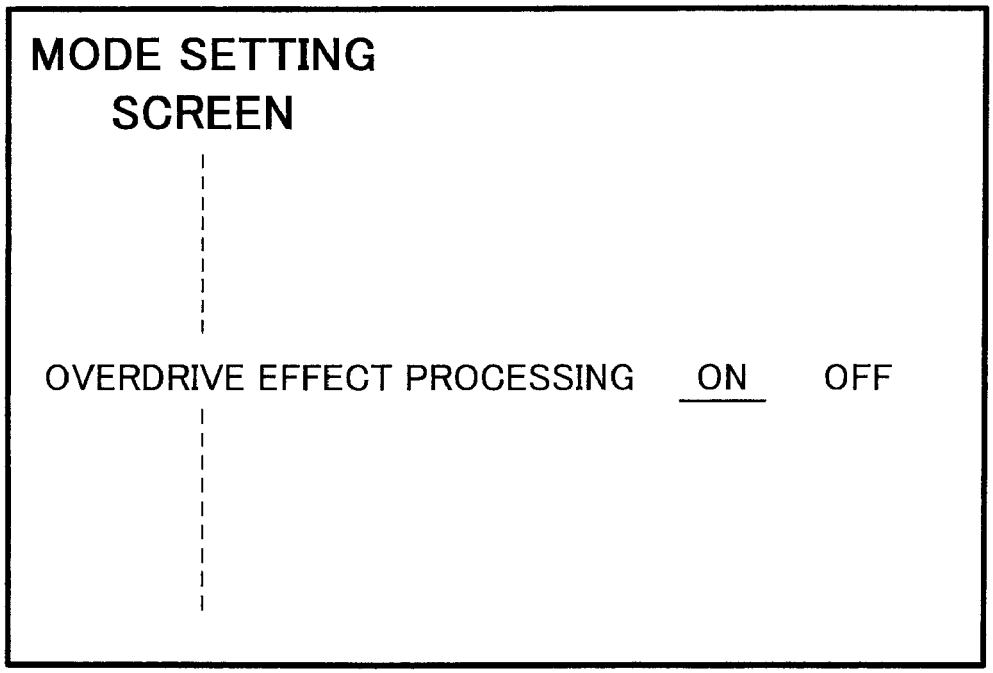

In FIGS. 22A and 22B, the adjustment screen for adjusting the effect intensity of the overdrive effect processing or the mode setting screen for setting whether or not to enable the overdrive effect processing is displayed.

In FIG. 22A, the object OB set in an intermediate color CN2 moves in a background area 210 (adjustment window) of the adjustment screen set in an intermediate color CN1, for example. A residual image significantly occurs by setting the background area 210 and the object OB in the intermediate colors other than the primary colors, whereby an adjustment screen can be provided which is suitable for adjusting the effect intensity of the overdrive effect processing.

The player adjusts the effect intensity (alpha value) of the overdrive effect processing by moving an adjustment slider 212 displayed on the screen by using the operation section while watching the image of the object OB. For example, when the player has noticed that the residual image of the object OB occurs to a large extent, the player increases the effect intensity of the overdrive effect processing by moving the adjustment slider 212 to the right. On the other hand, when the player has noticed that the residual image of the object OB does not occur to a large extent but the overdrive effect occurs to a large extent, the player decreases the effect intensity of the overdrive effect processing by moving the adjustment slider 212 to the left. The effect intensity (alpha value) thus adjusted is stored in the storage section of the image generation system or a portable information storage device such as a memory card. The overdrive effect processing of the game screen is performed based on the stored effect intensity (alpha value).

The adjustment screen display method is not limited to the method shown in FIG. 22A. In FIG. 22A, a circular object is moved. Note that an object with a shape other than the circle (e.g. pillar) may be moved. A plurality of objects may also be moved. Or, only the adjustment slider 212 (display object for designating the adjustment value) may be displayed without displaying the object. Various colors may be employed as the intermediate color set for the background area 210 and the object OB. For example, the image of the background area 210 or the object OB may be an image of two or more intermediate colors.

The mode setting screen shown in FIG. 22B is a screen for various game settings. For example, the mode setting screen is used for game sound setting (tone, volume, and stereo/monaural settings), operation section setting (button/lever setting), image display setting, and the like.

In the mode setting screen shown in FIG. 22B, the player may enable (ON) or disable (OFF) the overdrive effect processing by operating the operation section. When the overdrive effect processing has been enabled (selected), the overdrive effect processing of the game screen is performed.

The mode setting screen display method is not limited to the method shown in FIG. 22B. For example, the overdrive effect processing may be enabled and disabled by using the adjustment screen shown in FIG. 22A. In this case, the overdrive effect processing is disabled when the adjustment slider 212 shown in FIG. 22A has been moved to the leftmost side. The effect intensity of the overdrive effect processing may be adjusted by using the mode setting screen. In this case, the adjustment slider 212 shown in FIG. 22A may be displayed on the mode setting screen shown in FIG. 22B.

3. Hardware Configuration

Figure 23:
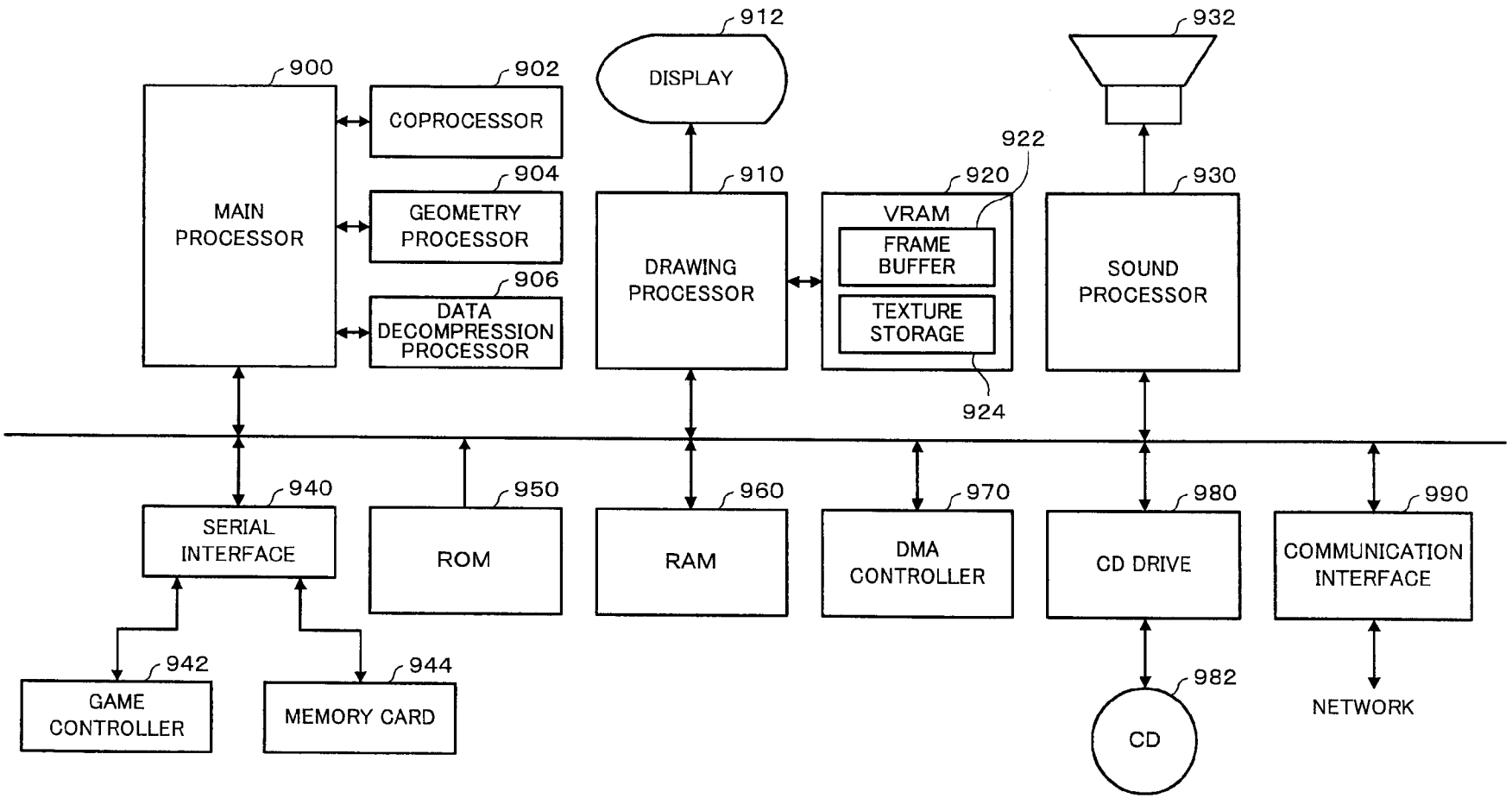
FIG. 23 is a diagram showing hardware configuration.

FIG. 23 is an example of a hardware configuration which can realize this embodiment. A main processor 900 operates based on a program stored in a CD 982 (information storage medium), a program downloaded through a communication interface 990, a program stored in a ROM 950, or the like, and performs game processing, image processing, sound processing, or the like. A coprocessor 902 assists the processing of the main processor 900, and performs matrix calculation (vector calculation) at high speed. When a matrix calculation is necessary for physical simulation to allow an object to move or make a motion, a program which operates on the main processor 900 directs (requests) the coprocessor 902 to perform the processing.

A geometry processor 904 performs geometric processing such as a coordinate transformation, perspective transformation, light source calculation, or curved surface generation based on instructions from a program operating on the main processor 900, and performs a matrix calculation at high speed. A data decompression processor 906 decodes compressed image data or sound data, or accelerates the decoding of the main processor 900. This allows a moving picture compressed according to the MPEG standard or the like to be displayed on an opening screen or a game screen.

A drawing processor 910 draws (renders) an object formed by a primitive surface such as a polygon or a curved surface. When drawing an object, the main processor 900 delivers drawing data to the drawing processor 910 by utilizing a DMA controller 970, and transfers a texture to a texture storage section 924, if necessary. The drawing processor 910 draws an object in a frame buffer 922 based on the drawing data and the texture while performing hidden surface removal utilizing a Z buffer or the like. The drawing processor 910 also performs alpha blending (translucent processing), depth queuing, MIP mapping, fog processing, bilinear filtering, trilinear filtering, anti-aliasing, shading, and the like. When the image of one frame has been written into the frame buffer 922, the image is displayed on a display 912.

A sound processor 930 includes a multi-channel ADPCM sound source or the like, generates game sound such as background music (BGM), effect sound, or voice, and outputs the generated game sound through a speaker 932. Data from a game controller 942 or a memory card 944 is input through a serial interface 940.

A system program or the like is stored in the ROM 950. In an arcade game system, the ROM 950 functions as an information storage medium, and various programs are stored in the ROM 950. A hard disk may be used instead of the ROM 950. A RAM 960 functions as a work area for various processors. The DMA controller 970 controls DMA transfer between the processor and the memory. A CD drive 980 accesses a CD 982 in which a program, image data, sound data, or the like is stored. The communication interface 990 transmits data to and receives data from the outside through a network (communication line or high-speed serial bus).

The processing of each section according to this embodiment may be realized by hardware and a program. In this case, a program for causing hardware (computer) to function as each section according to this embodiment is stored in the information storage medium. In more detail, the program issues instructions to each of the processors 900, 902, 904, 906, 910, and 930 (hardware) to perform the processing, and transfers data to the processors, if necessary. The processors 900, 902, 904, 906, 910, and 930 realize the processing of each section according to this embodiment based on the instructions and the transferred data.

Although only some embodiments of the invention have been described in detail above, those skilled in the art will readily appreciate that many modifications are possible in the embodiments without materially departing from the novel teachings and advantages of this invention. Accordingly, all such modifications are intended to be included within the scope of this invention. Any term (e.g. first, second, and third frames) cited with a different term (e.g. Jth, Kth, and Lth frames) having a broader meaning or the same meaning at least once in the specification and the drawings can be replaced by the different term in any place in the specification and the drawings.

The overdrive effect processing implementation method is not limited to the first and second implementation methods described in the above embodiment. A method equivalent to these methods is also included within the scope of the invention. For example, the overdrive effect processing may be realized by alpha blending differing from that of the first or second implementation method. Or, the overdrive effect processing may be realized without using the alpha blending. The overdrive effect processing according to the invention may also be applied to the case where the display section is not a liquid crystal display device.

The invention may be applied to various games. The invention may be applied to various image generation systems, such as an arcade game system, consumer game system, large-scale attraction system in which a number of players participate, simulator, multimedia terminal, system board which generates a game image, and portable telephone.

What is claimed is:

1. A non-transitory computer-readable information storage medium storing a program for generating an image, the program causing a computer to function as:

a drawing section which draws an object to generate image data; and an overdrive effect processing section which performs overdrive effect processing for the generated image data and generates image data to be output to a display section, wherein the overdrive effect processing section obtains differential image data in the Kth frame between image data generated in a Kth frame and image data generated in a Jth frame (K>J), and stores difference reduction image data obtained based on the differential image data in the Kth frame, and performs the overdrive effect processing in an Lth (L>K>J) frame based on differential image data in the Lth frame which is differential image data between image data generated in the Lth frame and image data generated in the Kth frame and the stored difference reduction image data, and wherein the overdrive effect processing section adds image data obtained by multiplying the differential image data in the Lth frame by the effect intensity coefficient and the difference reduction image data which is multiplied by an effect intensity coefficient smaller than that of overdrive effect processing in the Kth frame to the image data generated in the Lth frame.

2. The computer-readable information storage medium as defined in claim 1, wherein the overdrive effect processing section adds image data obtained by multiplying the differential image data in the Lth frame by the effect intensity coefficient and the stored difference reduction image data to the image data generated in the Lth frame.

3. The computer-readable information storage medium as defined in claim 1, wherein the overdrive effect processing section adds image data obtained by multiplying the differential image data by an effect intensity coefficient to the image data generated in the Kth frame.

4. The computer-readable information storage medium as defined in claim 1, wherein the overdrive effect processing section performs the overdrive effect processing based on the effect intensity coefficient which increases as a value of the differential image data increases.

5. The non-transitory computer-readable information storage medium storing a program for generating an image, as defined in claim 1, the program causing a computer to function as:

wherein the overdrive effect processing section generates image data subjected to the overdrive effect processing by performing alpha blending which calculates $IMK+(IMK-IMODJ)\times\alpha$ based on the image data IMK generated in the Kth frame, image data IMODJ after the overdrive effect processing generated in the Jth frame, and an alpha value $\alpha$, and the overdrive effect processing section generates the image data IMK by drawing the object in a drawing buffer, and writing into a display buffer the image data subjected to the overdrive effect processing by performing alpha blending which calculates $IMK+(IMK-IMODJ)\times\alpha$ based on the generated image data IMK, the image data IMODJ after the overdrive effect processing in the Jth frame which has been written into the display buffer, and the alpha value $\alpha$.

6. The computer-readable information storage medium as defined in claim 5, wherein the overdrive effect processing section maps a texture of the image data IMK onto a primitive plane with a screen size or a divided screen size in which the alpha value is set, and draws the primitive plane onto which the texture has been mapped in a buffer in which the image data IMODJ has been drawn while performing alpha blending.

7. The computer-readable information storage medium as defined in claim 5, the program causing the computer to function as:

a display control section which controls display of an adjustment screen for adjusting effect intensity of the overdrive effect processing, wherein, when the effect intensity has been adjusted by using the adjustment screen, the overdrive effect processing section performs the overdrive effect processing based on the effect intensity after the adjustment.

8. The computer-readable information storage medium as defined in claim 7, wherein the display control section moves an object set in a second intermediate color in a background area of the adjustment screen set in a first intermediate color.

9. The computer-readable information storage medium as defined in claim 5, the program causing the computer to function as:

a display control section which controls display of a mode setting screen for setting whether or not to enable the overdrive effect processing, wherein the overdrive effect processing section performs the overdrive effect processing when the overdrive effect processing has been enabled by using the mode setting screen.

* * * * *